US010280806B2

(12) United States Patent
Olivotti

(10) Patent No.: US 10,280,806 B2
(45) Date of Patent: May 7, 2019

(54) DRIVE UNIT WITH ITS DRIVE TRANSMISSION SYSTEM AND CONNECTED OPERATING HEAT CYCLES AND FUNCTIONAL CONFIGURATIONS

(71) Applicant: I.V.A.R. S.P.A., Prevalle (BS) (IT)

(72) Inventor: Sergio Olivotti, Altavilla Vicentina (IT)

(73) Assignee: I.V.A.R. S.P.A., Prevalle (IT)

( * ) Notice: Subject to any disclaimer, the term of this patent is extended or adjusted under 35 U.S.C. 154(b) by 172 days.

(21) Appl. No.: 15/116,047

(22) PCT Filed: Feb. 2, 2015

(86) PCT No.: PCT/IB2015/050787
§ 371 (c)(1),
(2) Date: Aug. 2, 2016

(87) PCT Pub. No.: WO2015/114602
PCT Pub. Date: Aug. 6, 2015

(65) Prior Publication Data

US 2017/0167303 A1 Jun. 15, 2017

(30) Foreign Application Priority Data

Feb. 3, 2014 (IT) ..... BS2014A0031
Feb. 3, 2014 (IT) ..... BS2014A0032

(51) Int. Cl.
*F01C 1/063* (2006.01)
*F01C 1/18* (2006.01)
(Continued)

(52) U.S. Cl.
CPC ..... *F01K 7/36* (2013.01); *F01C 1/063* (2013.01); *F01C 1/077* (2013.01); *F01C 1/18* (2013.01); *F01K 13/00* (2013.01)

(58) Field of Classification Search
CPC ..... F01C 1/063–1/077; F04C 2/063–2/077; F04C 18/063–18/077
(Continued)

(56) References Cited

U.S. PATENT DOCUMENTS 2,108,385 A * 2/1938 Murakami ..... F01C 1/077 418/36
2,248,484 A * 7/1941 Bancroft ..... F01C 1/063 60/604
(Continued)

FOREIGN PATENT DOCUMENTS

DE 29 10 990 A1 10/1980
DE 102007042460 B3 * 5/2009 ..... F01C 1/077
(Continued)

OTHER PUBLICATIONS

Badr, O. et al., "Expansion Machine for a Low Power-Output Steam Rankine-Cycle Engine", Applied Energy, Elsevier Science Publishers, Ltd., GB, vol. 39, No. 2, Jan. 1, 1991, pp. 93-116.
(Continued)

*Primary Examiner* — Laert Dounis
(74) *Attorney, Agent, or Firm* — Pearne & Gordon LLP

(57) ABSTRACT

The invention relates to a heat engine (29), including a drive unit (1) provided with: a casing (2) delimiting therein an annular chamber (12), two triads of pistons (7*a*-7*b*-7*c*; 9*a*-9*b*-9*c*) rotatably housed in the casing of the annular cylinder (or toroidal cylinder), a three-shaft movement system (18) configured to transmit motion from and/or to the two triads of pistons; wherein the heat engine is configured so as to carry out a Rankine or Rankine-Hirn thermodynamic cycle, capable of producing electrical energy and heat; the same invention further relates to a pneumatic motor (61) including the aforesaid drive unit (1), configured so as
(Continued)

to transform the compressed air at high pressure, contained in a tank, into mechanical energy.

9 Claims, 9 Drawing Sheets

(51) Int. Cl.
*F01K 7/36* (2006.01)
*F01C 1/077* (2006.01)
*F01K 13/00* (2006.01)

(58) Field of Classification Search
USPC ..... 418/33–38
See application file for complete search history.

(56) References Cited

U.S. PATENT DOCUMENTS

| | | | | |
|---|---|---|---|---|
| 2,902,830 | A * | 9/1959 | Lenz | F01K 3/205 122/235.11 |
| 3,396,632 | A * | 8/1968 | Leblanc | F01C 1/07 123/245 |
| 4,338,067 | A | 7/1982 | Greenfield | |
| 4,872,818 | A * | 10/1989 | Takami | F04C 2/067 418/36 |
| 5,147,191 | A | 9/1992 | Schadeck | |
| 5,224,847 | A | 7/1993 | Kurisu | |
| 6,461,127 | B1 * | 10/2002 | Kim | F01C 1/063 418/36 |
| 2008/0178847 | A1 | 7/2008 | Kudarauskas et al. | |
| 2009/0047160 | A1 * | 2/2009 | Dec | F01C 1/07 418/36 |
| 2010/0251991 | A1 * | 10/2010 | Drachko | F01C 1/07 123/221 |

FOREIGN PATENT DOCUMENTS

| | | | | |
|---|---|---|---|---|
| EP | 0 554 227 | A1 | 8/1993 | |
| FR | 840 949 | A | 5/1939 | |
| IT | MI2012A001944 | A1 | 5/2014 | |
| IT | MI2013A000040 | A1 | 7/2014 | |
| WO | 2006/118437 | A1 | 11/2006 | |
| WO | 2007/084376 | A2 | 7/2007 | |
| WO | 2008/061271 | A1 | 5/2008 | |
| WO | WO 2008061271 | A1 * | 5/2008 | F01C 1/077 |
| WO | 2014/076637 | A1 | 5/2014 | |

OTHER PUBLICATIONS

Clemente, Stefano et al., "Performance Analysis and Modeling of Different Voumetric Expanders for Small-Scale Organic Rankine Cycles", Proceedings of the ASME 2011 5th International Conference on Energy Sustainability, ES2011-54302, Aug. 7-10, 2011, Washington, DC, USA, pp. 1-10.

Glavatskaya, Yulia et al., "Reciprocating Expander for an Exhaust Heat Recovery Rankine Cycle for a Passenger Car Application", Energies, Jun. 5, 2012, ISSN 1996-1073, www.mdpi.com/journal/energies, pp. 1751-1765.

* cited by examiner

DRIVE UNIT WITH ITS DRIVE TRANSMISSION SYSTEM AND CONNECTED OPERATING HEAT CYCLES AND FUNCTIONAL CONFIGURATIONS

FIELD OF THE INVENTION

The present invention relates to a "rotary drive unit", motion transmission system thereof and associated thermal operating cycles and functional configurations (hereinafter defined simply as "drive unit"), utilizable in heat engines operating with Rankine, Rankine-Hirn, Brayton and Stirling heat cycles, and usable as a hydraulic motor, pneumatic motor, pneumatic compressor, volumetric pump and in many other applications that can exploit its innovative motor features.

In particular, the present inventive idea can have a priority application in the production of electricity, in a cogeneration and trigeneration context, with or without heat recovery and, in a particular arrangement aimed at reducing polluting emissions, it could also have a place as an external combustion engine in the automotive sector.

The present patent application claims the priority of Italian patent applications no. BS2014A000031 and no. BS2014A000032, filed on Feb. 3, 2014 in the name of the same Applicant. The entire content of the Italian patent applications no. BS2014A000031 and no. BS2014A000032 is incorporated herein by reference.

BACKGROUND OF THE INVENTION

Some historical considerations concerning thermodynamic cycles were already set forth in the description of patent applications MI2013A000040 (pages 1-9) and MI2012A001944 (pages 1-8) in the name of the same Applicant, and it is therefore deemed useful to mention the more significant innovative parts forming the subject matter of the present inventive idea, regarding a new system for the transmission of motion between the pistons and the drive shaft, the use of the drive unit in some further extensions of the Rankine-Hirn heat cycle, the use thereof with a new heat cycle derived from the Stirling cycle and the use thereof in a new compressed air motor.

Theory of the Stirling Heat Cycle

In 1816 Robert Stirling introduced a hot air engine with an open circuit, characterized by an intermittent flow made up of four phases: intake of air at atmospheric pressure (at ambient temperature), compression of the air taken in, rapid heating and expansion of the pre-compressed air and expulsion of the exhaust air (into the environment).

In a subsequent evolution of the Stirling cycle, with the aim of increasing thermal efficiency while maintaining the four-phase cycle unchanged, a bi-directional heat exchanger defined as a "regenerator" was introduced into the circuit; subsequently, multiple solutions with different types of closed-circuit reciprocating and rotary engines were developed.

The basic Stirling cycle is very schematically represented in FIG. 9. It consists of two adiabatic transformations and two isothermal transformations.

The area comprised between the four transformations defining the cycle represents the net work "L" obtained through the cycle. This work is obtained as the difference between the positive work 1–2+2–3 and negative work 3–4+4–1.

The total heat "Q" which the heat engine retains is likewise given by the difference between the heat it has absorbed ($Q_2$) and the heat it has discharged ($Q_1$); therefore, the work that the heat engine is capable of producing is given by:

$$L=Q_2-Q_1$$

Based on the above, we can affirm that only part of the heat supplied to the heat engine is transformed into work, whilst the remaining part is necessarily discharged outside the system. For heat engines, it is thus possible to define efficiency as the ratio between the work the machine produces and the heat necessary to input to the machine, i.e.

$$\eta=L/Q_2$$

Essentially, in order to improve thermal efficiency it is necessary to increasingly diminish the quantity $Q_1/Q_2$, which is subtracted from the value 1 and which reduces efficiency. For this purpose, the values of the numerator and denominator must be as far away from each other as possible, i.e. the hot source must work at the highest temperature possible and the cold source must be at the lowest temperature possible.

The temperature of the hot source is subject only to technological limitations tied to use, cycle and materials, whilst as regards the temperature of the cold source there are limited possibilities of intervention: in fact, it is typically necessary to use the temperature of the outside environment or that of a coolant fluid made to circulate in a specific exchanger.

Overall, various machines functioning with a Stirling heat cycle have been developed and others are still at an experimental stage. However, the Applicant has found that even already industrialized solutions have limitations and can be improved in several respects. This applies, in particular, for Stirling engines used to drive small and medium power autonomous electric generators (below 50 KWh).

In practice, besides the various types of Stirling engines, the following are presently used to drive electric generators:

- reciprocating internal combustion engines, which are mechanically complicated, noisy (and also for this reason are made to operate at a low rpm), are particularly polluting and have high maintenance costs;
- gas turbines, which, besides being particularly costly, are not competitive in small-scale applications.
- engines using the Rankine or Rankine-Hirn cycle, to which the present inventive idea also relates, but which, given the need to use a steam generator, can be strongly competitive only in fixed cogeneration applications (where it is possible to almost entirely recover the residual heat of the heat cycle), require further technological innovations in order to be profitably used also in small-scale mobile applications.

In general, all of the prior art solutions, in addition to the problems of pollution, low efficiency, mechanical complexity and high maintenance costs, are also characterized by a cost-benefit ratio that is not particularly satisfactory.

Theory of the Compressed Air Motor Cycle

The engine exploits the energy contained in tanks of compressed air which, according to the ideal gas law, is maximum for an isothermal transformation and is equal to:

$$\text{Energy} = P_1 V_1 * \ln\left(\frac{P_1}{P_2}\right)$$

where $P_1$ is the initial pressure of the tanks and $V_1$ is the volume of transformation, equal to the cubic volume of the engine, whilst $P_2$ is the atmospheric pressure.

With pressures that are not too high and temperatures that are not too low, compressed air behaves like an ideal gas with excellent approximation and the energy it contains is thus given by the above formula.

Let us indicate the energy P1V1*Ln(P1/P2) as Emax, the energy of a perfectly isothermal transformation.

Let us indicate as E the mechanical energy that the compressed air motor transforms starting from tanks of volume V2 and pressure P2.

Thus the engine's efficiency is given by:

$$Eff=E/E\max$$

As in general the energy of the transformation is equal to the area (integral) below the transformation curve in the Clapeyron diagram.

In the case of an adiabatic transformation, the energy, or work, is in fact for this transformation:

$$E\text{adiab}=(P1V1-P2V2)/(g-1)$$

$$g=Cp/Cv$$

$$PV^{g}=\text{cost}$$

where Cp for air is about 1.00 and Cv for air is about 0.72. The efficiency is equal to:

$$Eff=E\text{adiab}/E\max$$

SUMMARY

The Applicant has observed that if one wishes to extend the use of such rotary drive units in heat engines and cogeneration (and possibly trigeneration) units for small users, for example individual homes, compactness and overall efficiency are fundamental.

In this regard, the publication "*Expansion machine for a low power output steam Rankine cycle engine*" (O. Badr et al., Applied energy, Elsevier science publisher, GB, vol. 39, no. 2, 1 Jan. 1991, pages 93-116) describes the cogeneration of electricity and heat using a Rankine steam cycle and suggests using expanders of a rotary type ("vane" or "Wankel" expanders).

Publication ES2011-54302 of the University of Trieste: "Performance analysis and modeling of different volumetric expanders for small-scale organic Rankine cycles", addresses the subject of the expanders used in specific organic Rankine cycles.

The paper "Reciprocating Expander for an Exhaust Heat Recovery Rankine Cycle for a Passenger Car Application" published in the journal Energies, publication ISSN 1996-1073, addresses the subject of the expanders that may be used in the automotive field.

In this context, the Applicant set the objective of proposing a "drive unit" capable of being used in diversified heat cycles where it is possible to exploit a high flow rate of a working fluid with a considerable increase in the amount of work that may be obtained compared to other known units of the same type, whilst containing the size and weight of the unit itself.

In the specific realm of heat cycles, the Applicant proposes preferable but not exclusive embodiments envisaging the use of the aforesaid "drive unit" in three different operating configurations using, respectively, the Rankine cycle, the Rankine-Hirn cycle and a new heat cycle derived from the Stirling and Brayton-Joule cycles, with the principal aim of being able to produce electricity using diversified energy sources. The Applicant also proposes a particular application, as a pneumatic motor, capable of reducing and/or eliminating the formation of ice on the outlet side of the engine.

Therefore, the object at the basis of the present invention, in the various aspects and/or embodiments thereof, is to remedy one or more of the above-mentioned drawbacks by providing a "drive unit", capable of using multiple heat sources and capable of generating mechanical energy (work) with a high overall efficiency, being able to be used in any place and for any purpose, but preferably for the production of electrical energy, given the considered added value thereof.

A further object of the present invention is to provide a "drive unit" characterized by high thermodynamic efficiency and an excellent power-to-weight ratio.

A further object of the present invention is to propose a "drive unit" characterized by a mechanical structure that is simple and can be quickly built.

A further object of the present invention is to be able to produce a "drive unit" characterized by a reduced cost of production.

These objects, and any others that will become more apparent in the course of the following description, are substantially achieved by a "drive unit" having a series of particular aspects.

In one aspect, the drive unit is substantially composed of:

- an engine block formed by a casing provided with an internal cavity defining a toroidal cylinder (or annular cylinder);
- two triads of pistons rotatably housed inside the toroidal cylinder (or annular cylinder), each triad being connected to a respective drive rotor, with the pistons of the two triads alternating with each other;
- a three-shaft transmission a with a train of four three-lobe gears housed in a specific case, configured and designed to transmit motion from and/or to the two triads of pistons, the transmission comprising a primary shaft (or drive shaft), a first secondary shaft and a second secondary shaft, each secondary shaft being connected, via drive rotors to a respective triad of pistons;
- a first rotor and a second rotor connected respectively to a first and a second auxiliary shaft and rotatably installed in the casing; wherein each of the two rotors is mechanically integral with three pistons which are angularly offset from each other by 120° and slide in the annular chamber; wherein the pistons of one of the rotors are angularly alternated with the pistons of the other rotor so that the angularly adjacent pistons form and delimit each of the six variable-volume chambers that come to be created.

In one aspect, the annular chamber has a rectangular or square cross section and the pistons, being of mating shape, are respectively rectangular or square.

In one aspect, the annular chamber has a circular cross section (extending toroidally) and the pistons, being of mating shape, have a circular cross section (extending toroidally).

In one aspect, the toroidal cylinder (or annular cylinder) is provided with a number of mutually distinct inlet openings for the entry of a high-temperature thermal fluid into the cylinder and a number of mutually distinct discharge openings for evacuating the spent thermal fluid, making reference, respectively, to two different sections which are used "in parallel", that is, with an equivalent expansion of the thermal fluid taking place in both.

In one aspect, the toroidal cylinder (or annular cylinder) is provided with a number of mutually distinct inlet openings for the entry of a high-temperature thermal fluid into the cylinder and a number of mutually distinct discharge openings for evacuating the spent thermal fluid, making reference, respectively, to two different sections which are used "in series", that is, with an expansion taking place on two different pressure and temperature levels of the thermal fluid in each of the two sections.

In one aspect, the toroidal cylinder (or annular cylinder) is provided with a number of mutually distinct inlet openings for the entry of a high-temperature thermal fluid into the cylinder and a number of mutually distinct discharge openings for evacuating the spent thermal fluid, making reference, respectively, to two different sections which can be used "in parallel", that is, with an equivalent expansion of the thermal fluid taking place in the two sections, or else "in series".

In one aspect, the toroidal cylinder (or annular cylinder) is provided with a number of mutually distinct inlet openings for the entry of a high-temperature thermal fluid into the cylinder and a number of mutually distinct discharge openings for evacuating the spent thermal fluid, making reference, respectively, to two different sections which are used "in series", that is with an expansion taking place on two different pressure and temperature levels of the thermal fluid in the two sections.

In one aspect, the annular chamber has three inlet positions (with differently made openings varying in number and size) and three discharge positions (with differently made openings varying in number and size), which are variably configured so as to be adapted to the thermodynamic cycle used.

In one aspect, each of the six chambers expands three times and contracts three times for per each complete revolution (360°) of the primary shaft.

In one aspect, all of the inlet/discharge openings, used for the passage of the thermal fluid, are fashioned on the casing of the toroidal (or annular) cylinder.

In one aspect, the inlet/discharge openings are symmetrical and offset from one another by 120° on average, it being possible to define, in a single toroidal (or annular) cylinder, three distinct inlet sections and three distinct discharge sections for the thermal fluid.

In one aspect, the toroidal cylinder (or annular cylinder) is provided with one or more inlet openings for the entry of the cooled thermal fluid into the cylinder and one or more discharge openings for evacuating the thermal fluid compressed in the compensating tank.

In one aspect, by means of a manual or automatic angular rotation of the case containing the transmission, relative to the inlet/discharge openings, it is possible to time the phases of the heat cycle to come earlier or later in order to optimize thermodynamic efficiency.

In one aspect, by means of a manual or automatic angular rotation of the case containing the transmission, relative to the inlet/discharge openings, it is possible to time the phases of the heat cycle to come earlier or later in order to enable autonomous starting of the engine apparatus.

In one aspect, the first triad of pistons is an integral part of a first rotor and the second triad of pistons is an integral part of a second rotor.

In one aspect, the three pistons of each of the two rotors are angularly equidistant from one another.

In one aspect, the three pistons of each of the rotors are rigidly connected together so as to rotate integrally with one another.

In one aspect, the first secondary shaft is solid and integrally joined at one end with a first three-lobe gear and at the opposite end with the first rotor.

In one aspect, the second secondary shaft is hollow and integrally joined at one end with a respective second three-lobe gear and at the opposite end with the second rotor.

In one aspect, the primary shaft (or drive shaft) is integrally joined with a first and a second three-lobe gear, positioned at 60° from each other.

In one aspect, the transmission of the drive unit comprises:

- a first auxiliary shaft on which the first rotor is mounted;
- a second auxiliary shaft on which the second rotor is mounted;
- a first three-lobe gear and a second three-lobe gear keyed onto the primary shaft and angularly offset by an angle of 60°;
- a third three-lobe gear, keyed onto the first auxiliary shaft;
- a fourth three-lobe gear, keyed onto the second auxiliary shaft;

wherein the first three-lobe gear is functionally operating with the third three-lobe gear and the second three-lobe gear is functionally operating with the fourth three-lobe gear.

In one aspect, the first auxiliary shaft is coaxially inserted in the second auxiliary shaft or vice versa.

In one aspect, the axis of the primary shaft is parallel to and appropriately distanced from the axis of the first shaft and second shaft.

In one aspect, each three-lobe gear has concave and/or flat and/or convex connecting portions between its lobes.

In one aspect, each three-lobe gear, as may be inferred from the definition thereof, has a substantially triangular profile.

In one aspect, a rotation having a constant angular velocity of the primary shaft (or drive shaft) determines a periodic variation in the angular velocity of rotation of the two secondary shafts.

In one aspect, the primary shaft (or drive shaft) determines a periodic cyclical variation of the angular velocity of the first and second secondary shafts and of the corresponding triads of pistons rotating inside the toroidal cylinder (or annular cylinder), enabling the creation of six distinct rotating chambers with a variable volume and ratio.

In one aspect, the transmission of motion between the pistons and the primary shaft (or drive shaft) is obtained with the train of three-lobe gears which connects the first and second secondary shafts to the primary shaft, characterized in that while the primary shaft (or drive shaft) rotates with a constant angular velocity, the two secondary shafts rotate with an angular velocity that is periodically higher than, equal to or lower than the primary shaft.

In one aspect, without prejudice to the inventive idea, the drive unit can be provided with any system whatsoever for transmitting motion between the two triads of pistons and the primary shaft (such as, for example, the one claimed in U.S. Pat. No. 5,147,191 and EP0554227A1), it being possible to adopt any mechanism able to transform the rotary motion of the primary shaft, which has a constant angular velocity, into a rotary motion with a periodically variable angular velocity of the two secondary shafts, functionally connected to the two triads of pistons.

In one aspect, the drive unit can be configured, by means of suitable thermal fluid conveying conduits, in such a way that the various components and various operating sections can be operatively connected, manually or automatically, with the corresponding inlet/discharge openings.

In one aspect, the drive unit is completely devoid of inlet/discharge valves and the associated mechanisms, since the triads of pistons, by moving in the toroidal cylinder (or annular cylinder), themselves determine the opening and the closing of the inlet/discharge openings for the thermal fluid.

In one aspect, the heat engine which uses the drive unit can be configured with check valves appropriately positioned in the thermal fluid conveying conduits, in such a way as to optimize the heat cycle by aiding the work of the pistons in the function of opening-closing the inlet/discharge openings.

In one aspect, the heat engine which uses the drive unit can comprise one or more thermal fluid heaters configured in such a way as to be able to provide the fluid with the heat energy serving to increase its temperature and pressure, in turn used to set the two triads of pistons in rotation.

In one aspect, the drive unit is connected to a generator capable of producing electricity intended to be used for any purpose.

In one aspect, the heat engine which uses the drive unit comprises a heat energy regulating system, configured to regulate the delivery pressure and/or temperature of the thermal fluid in the various stages of the process.

In one aspect, the drive unit can be configured so as to function with a Stirling operating cycle, wherein the drive unit can perform functions of compressing and expanding the thermal fluid.

In one aspect, the drive unit can be configured so as to function with a Rankine or Rankine-Hirn operating cycle, wherein the drive unit is used as an "expander".

In one aspect, the drive unit can be configured so as to function with an open Brayton cycle, wherein the drive unit performs compression and expansion functions.

In one aspect, the drive unit can be configured so as to exploit the pressure of a liquid, wherein the drive unit performs the function of a "hydraulic motor".

In one aspect, the drive unit can be configured so as to exploit the pressure of a gas, wherein the drive unit performs the function of a "pneumatic motor".

In one aspect, the drive unit can be configured so as to impart velocity to a liquid flowing in a pipe, wherein the drive unit performs the function of a "hydraulic pump".

In one aspect, the drive unit can be configured so as to compress a gas, wherein the drive unit performs the function of a "pneumatic compressor".

In one aspect, the drive unit can be configured so as to suck in a gas, wherein the drive unit performs the function of a "vacuum pump".

In other aspects, the drive unit can be appropriately configured so as to perform many other diversified functions.

In one aspect, the "heat engine" which uses the drive unit is configured so as to function with a new "pulsating heat cycle" featuring a continuous, unidirectional motion of the thermal fluid, which serves to considerably increase the power-to-weight ratio and also the overall efficiency of the heat engine.

In one aspect, the drive unit is suitable for being employed as an apparatus capable of producing mechanical energy using flows of pressurized thermal fluid heated with any source of heat.

In one aspect, heating of the circulating thermal fluid can be achieved using a fuel burner (for example a gas burner) or any other external source of heat—for example, solar energy, biomass, unrefined fuel, high-temperature industrial waste, or another source suitable for heating the thermal fluid itself.

In one aspect, the drive unit is a rotary volumetric machine.

In one aspect, the rotary volumetric machine comprises:

a casing delimiting therein an annular chamber and having "n" pairs of inlet/discharge openings in fluid communication with the annular chamber, wherein each inlet opening is angularly spaced from the respective discharge opening of the same pair so as to define an expansion/compression pathway for a working fluid in the annular chamber;

a first rotor and a second rotor rotatably installed in the casing; wherein each of the two rotors has "n" pistons slidable in the annular chamber; wherein the pistons of one of the rotors are angularly alternated with the pistons of the other rotor; and wherein angularly adjacent pistons delimit each of "2*n" variable-volume chambers;

a primary shaft operatively connected to the first and second rotors;

a transmission operatively interposed between the first and second rotors and the primary shaft and configured so as to transform the rotary motion of the primary shaft into a rotary motion with respective first and second variable angular velocities of the first and second rotors that are offset relative to each other; wherein the transmission is configured so as to confer on the periodically variable angular velocity of each of the rotors "n" periods of oscillation for each complete revolution of the primary shaft;

wherein "n" is greater than or equal to three.

In one aspect, the transmission comprises:

a first auxiliary shaft on which the first rotor is mounted;

a second auxiliary shaft on which the second rotor is mounted;

a first gear with "n" lobes and a second gear with "n" lobes keyed onto the primary shaft and angularly offset by an angle of 180°/"n";

a third gear with "n" lobes keyed onto the first auxiliary shaft;

a fourth gear with "n" lobes keyed onto the second auxiliary shaft;

wherein the first gear is enmeshed with the third gear and the second gear is enmeshed with the fourth gear.

In one aspect, each gear has concave or flat or convex connecting portions between its lobes.

In one aspect, "n"=3 and each gear has a substantially triangular profile, with rounded, concave lobes and convex connecting portions interposed between the lobes.

In one aspect, the machine (1) is a rotary volumetric expander.

In one aspect, the ratio between a passage area of an inlet opening and the passage area of a discharge opening is comprised between about 1/40 and about 1/4.

In one aspect, the invention relates to a generation or cogeneration plant comprising:

the aforesaid rotary volumetric expander;

a steam generator disposed upstream of the rotary volumetric expander and in fluid communication with the inlet openings of the rotary volumetric expander, in order to supply thereto a flow of saturated steam able to rotate the rotors of the rotary volumetric expander;

an electric generator connected to the primary shaft of the rotary volumetric expander, so as to receive mechanical energy and produce electrical energy.

In one aspect, the plant comprises an exchanger/condenser disposed downstream of the rotary volumetric expander and in fluid communication with the discharge openings of the rotary volumetric expander, so as to receive a flow of spent steam and extract heat therefrom.

In one aspect, at least one discharge opening of the expander is in fluid communication, through at least one conduit external to the annular chamber, with at least one inlet opening of the expander.

In one aspect, the plant comprises at least one heater operatively active on the at least one external conduit.

Example Comparing Drive Units with Four and Six Pistons

Compared to a drive unit of the known type, provided with only two pistons for each of the rotors (such as, for example, the one illustrated in document WO 2008/061271 A1), the drive unit according to the present invention has, other parameters (piston diameter, average cylinder diameter, number of revolutions) being equal, a much greater useful displacement.

From a different viewpoint, the useful power produced being equal, the drive unit has much more compact dimensions, a lower weight, slower rotation speeds, smaller inertial force, less mechanical friction and greater overall efficiency.

In order to better demonstrate the importance of the present inventive idea, taking into account the real mechanical design constraints imposed by the system for transmitting motion from the pistons to the drive shaft, below we present an example comparing a prior art drive unit (provided with two pistons for each of the two rotors, i.e. four pistons) and a drive unit according to the present invention (provided with three pistons for each of the two rotors, i.e. six pistons), where the pistons of both drive units have an equivalent circular (or toroidal) cross section, like the one illustrated in FIGS. 2*a* and 2*b*.

As is evident from Table 1 below, given the same rotation speed and overall dimensions of the drive unit, the technical solution according to the invention makes it possible to obtain a total useful displacement (normalized to one revolution of the primary shaft) that is almost double, a drastic decrease in inertial stresses and an extremely favourable power-to-weight ratio.

TABLE 1

| DESCRIPTION | Prior art - 4 pistons | Invention - 6 pistons | Notes |
|---|---|---|---|
| Useful expansions per revolution of primary shaft | 8 | 18 | phases |
| Piston diameter | 40 | | mm |
| Average diameter of annular cylinder | 118 | | mm |
| Angular dimensions in input phase | 1 | | ° |
| Maximum angular expansion | 50 | 45 | ° |
| Angular dimension of a piston | 64 | 38 | ° |
| Volume of a piston | 83 | 49 | cc |
| Total weight of pistons | 2.78 | 1.65 | kg |
| Rotation speed | 3000 | | rpm |
| Centrifugal force of 1 piston | 4,051 | 2,405 | N |
| Total useful displacement | 572 | 1,085 | cc |
| Moment of inertia lx | 675 | 401 | Kg/mm$^2$ |
| Moment of inertia ly | 5.510 | 2.466 | Kg/mm$^2$ |
| Moment of inertia lz | 5.847 | 4.685 | Kg/mm$^2$ |
| Kinetic energy at the rotation speed | 269 | 170 | J |

Additional features will become more apparent from the following detailed description of the drive unit, according to the present inventive idea, and of some preferred embodiments of the use thereof, regarding, respectively, a "heat engine" with a Rankine and Rankine-Hirn operating cycle, a "heat engine" functioning with an innovative operating heat cycle derived from the Stirling cycle (conventionally defined as a "pulsating heat cycle") and a "pneumatic motor". The description will be set forth below with reference to the appended drawings, provided solely by way of illustration and not by way of limitation.

For the sake of simplicity, in the following descriptions that refer to the Rankine and Rankine-Hirn cycles the path followed by the thermal fluid in the drive unit 1 will be explained as if a single complete heat cycle were carried out. In reality, for each revolution of the drive shaft (with a total revolution angle of 360°) in the drive unit 1, according to the specific configuration, "n" complete heat cycles can be carried out.

It is also necessary to take into account that, in the "rest" condition (with the generator inactive) the thermal fluid (water or organic fluid) is at the same temperature as the surrounding environment, at a predetermined static pressure, and is entirely contained in the closed circuit of the heat engine 29.

The heat cycle, in its complete form (apart from start-up), is carried out continuously in several phases of thermodynamic variation of the fluid: heating, superheating, intake and expansion (and corresponding production of useful work), expulsion, condensation and pumping back, as described below in the various configurations.

With reference to FIGS. 4 to 8, the functional configurations, given by way of a non-limiting example of the present invention, represent a heat engine comprising the drive unit, used as a "volumetric expander", in accordance with one or more of the preceding aspects, configured so as to carry out a Rankine heat cycle (without superheating) or Rankine-Hirn cycle (with one or two superheating steps). In these configurations, the heat engine comprises:

- a steam generator in direct fluid communication with the drive unit, in order to supply it with a flow of saturated steam capable of being expanded to produce "work";
- a first steam superheater in fluid communication the drive unit, in order to supply it with a flow of superheated steam capable of being expanded to produce "work";
- a second steam superheater in communication with the drive unit, in order to supply it with a flow of superheated steam capable of being expanded to produce "work";
- a "drive unit", according to the present invention, used as a "volumetric expander" capable of transforming the heat energy contained in the steam into mechanical energy (work), usable to drive the electric generator;
- a condenser in fluid communication with and interposed between the drive unit and the high-pressure pump in order to receive a flow of spent steam and extract heat therefrom usable for other purposes;
- a high-pressure pump (powered separately or directly driven by the same drive unit) in fluid communication with and interposed between the condenser and the steam generator, capable of conveying the condensed fluid back into the generator and thereby assuring the continuity of the "closed-circuit" heat cycle;
- an electric generator connected to the primary shaft of the drive unit, so as to receive mechanical energy and produce electrical energy, usable for various purposes.

For the sake of simplicity, in the following descriptions of the operating configurations that refer to a new "pulsating heat cycle" derived from Stirling, the path followed by the thermal fluid in the drive unit 1 will be explained as if a single complete heat cycle were carried out. In reality, for each revolution of the drive shaft (with a total revolution angle of 360°) in the drive unit 1, according to the specific configuration, "n" complete heat cycles are carried out.

It is also necessary to take into account that, in the "rest" condition (without heating), the thermal fluid (air, hydrogen, helium, nitrogen or other fluid) is at the same temperature as the surrounding environment, at a predetermined static pressure, and is entirely contained in the closed circuit of the heat engine 51.

The heat cycle, in its complete form (apart from start-up), is carried out continuously in several phases of thermodynamic variation of the fluid: compression, heating, intake, expansion (and corresponding production of useful work), expulsion, and regeneration-cooling, as described below in the following configurations.

With reference to FIGS. 10 and 11, the functional configurations, given by way of non-limiting example of the present invention, represent a heat engine comprising the drive unit, used as a "volumetric compressor-expander", in accordance with one or more of the preceding aspects, configured so as to carry out a new heat cycle derived from the Stirling cycle and conventionally defined a "pulsating heat cycle". In these configurations, the heat engine comprises:

- a "heater" in direct fluid communication with and interposed between the regenerator and the drive unit, which has the purpose of supplying the latter with the thermal fluid at a high temperature/pressure;
- a "drive unit" (with four or six pistons), in fluid communication with and interposed between the cooler, the compensating tank and the heater, used with the functions of a compressor and an expander, to transform the heat energy contained in the circulating fluid into mechanical energy (work);
- a "regenerator" in fluid communication with and interposed between the drive unit and the heater, able to remove heat from the spent thermal fluid in order to preheat the thermal fluid which will then be superheated;
- a "cooler", in fluid communication with and interposed between the regenerator and the drive unit, able to remove further heat from the thermal fluid in circulation in order to cool it and thereby increase the molecular quantity of the fluid which will be subsequently taken in and then compressed;
- a "compensating tank" provided with two check valves, in fluid communication with and interposed between the drive unit and the regenerator, which has the primary purpose of creating the best conditions for a continuous supply of compressed fluid to the regenerator and, in cascade fashion, to the heater, in such a way as to carry out a new "pulsating heat cycle" (derived from the Stirling cycle) with a substantial improvement in overall efficiency.

Note on the "Pulsating Heat Cycle".

The rapid heating and discharge of the thermal fluid which passes through the heater (its movement conditioned by the opening of the inlet/discharge openings opened and closed by the rotating pistons) generates the very particular high-frequency "pulsating" effect which characterizes the heat cycle of this heat engine and differentiates it from all the other heat cycles known to date (to give an example: a rotation speed of 1,200 rpm of the primary shaft will have 120 heat cycles per second corresponding to it).

With reference to the previously described theoretical principles regarding compressed air motors, in order to extract all the energy from the compressed air, it is necessary for the expansion of the latter to take place in the engines at a temperature that is as constant as possible, and given that the air cools during expansion, it must be heated accordingly along its path.

In practical terms, in order to get power from the engine, heat must be quickly supplied to the air during the isothermal transformation (expansion of the air in the drive unit), but this cannot be achieved at the desired speed, so the air cools and expansion thus does not take place under optimal conditions.

To be able to extract more energy from the compressed air, therefore, a series of adiabatic and isochoric transformations must be carried out in order to get closer to the isothermal transformation which enables the maximum energy to be obtained from the gas. This is done by carrying out a rapid, partial expansion up to a pressure P3 ($P1<P3<P2$) in the first stage of the drive unit (adiabatic transformation); then the cooled air ($T3<Tamb$) is heated ($T4=Tamb$) by means of a "heater" (isochoric transformation).

This first stage is followed by another two identical stages: rapid expansion of the air in the second stage of the same drive unit up to a pressure P5 ($P1<P5<P3<P2$), heating of the air by means of the "heater", until arriving at the third stage of the same drive unit which expands the air to atmospheric pressure.

In the pressure-volume diagram for ideal gases (Clapeyron diagram), the first stage described above requires a passage from point (P2,V2) to point (P4,V4) not along the hyperbola PV=const of the isothermal transformation, but rather along a first adiabatic curve up to point (P3,V3), and then point (P4,V4) is arrived at via a second isochoric curve. This entails a loss of energy at each stage relative to the energy that can be extracted from the air through an isothermal transformation, a loss that will be smaller the closer together the points (P2,V2) and (P4,V4) are in the diagram.

Based on the above, it may be deduced that the larger the number of stages, and hence of expansion chambers, the more energy it will be possible to extract from the compressed air.

On the other hand, however, the drive unit also has friction which decreases the energy that can be extracted from the air, so the number of stages should be determined in such a way as to make the engine's efficiency as high as possible.

In order to have a further comparative reference, let us consider that an exclusively adiabatic transformation and thus: rapid expansion of the air in a single stage until reaching ambient pressure, implies much lower efficiencies, without counting the almost inevitable formation of ice.

For the sake of simplicity, in the following description of the operating configuration, the path followed by the compressed air in the various sectors will be explained in reference to a single drive unit. In reality, one could use a number of rotary drive units functioning in "cascade" fashion in order to increase the number of stages and intermediate heating steps. This possibility is especially important considering that in order to be used in a car, the air would have to be compressed in the tank up to a pressure that could also exceed 300 Bars.

It is also necessary to take into account that, in the "rest" condition, the air contained in the tank is at the same temperature as the surrounding environment.

The transformation cycle with reference to a single drive unit, in its complete form, is carried out continuously, in several phases of thermodynamic variation of the fluid, namely: first expansion (and corresponding production of useful work); heating; second expansion (and corresponding production of useful work); heating; third expansion (and corresponding production of useful work); heating; and expulsion at atmospheric pressure into the open air.

The pneumatic motor according to the present inventive idea is characterized by a three-stage expansion which prevents or reduces the possible formation of ice on the outlet of the motor itself, so that the use thereof can also be extended to the automotive sector.

With reference to FIG. 12, the functional configuration, given by way of non-limiting example of the present invention, represents a pneumatic motor comprising a single drive unit with six pistons, used as a "volumetric expander", in accordance with one or more of the preceding aspects and configured so as to derive mechanical energy usable for any purpose. In this configuration the pneumatic motor 61 comprises:

- a "compressed air tank", in direct fluid communication with the drive unit and provided with a specific shut-off valve;
- a "drive unit" (with six pistons), in fluid communication with the compressed air tank and used with the functions of an expander to produce mechanical energy (work);
- a number of "heaters", in direct fluid communication with the drive unit, and which have the purpose of heating the compressed air in the various sectors of use thereof.

DESCRIPTION OF THE DRAWINGS

The description will be set forth here below with reference to the appended drawings, provided only for illustrative purposes and thus non-limiting, in which.

DETAILED DESCRIPTION OF THE DRIVE UNIT

Figure 2A:
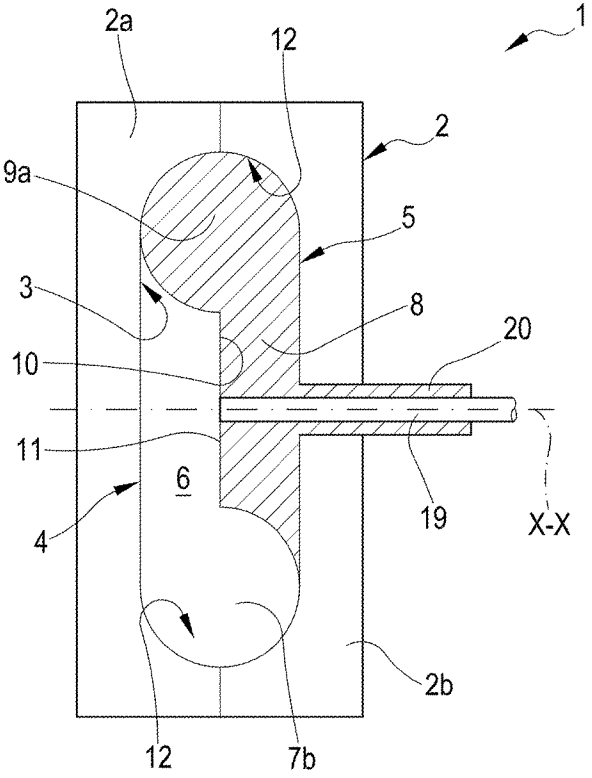
FIG. 2*a* illustrates a side sectional view of the central body of the drive unit in FIG. 1.
Figure 1:
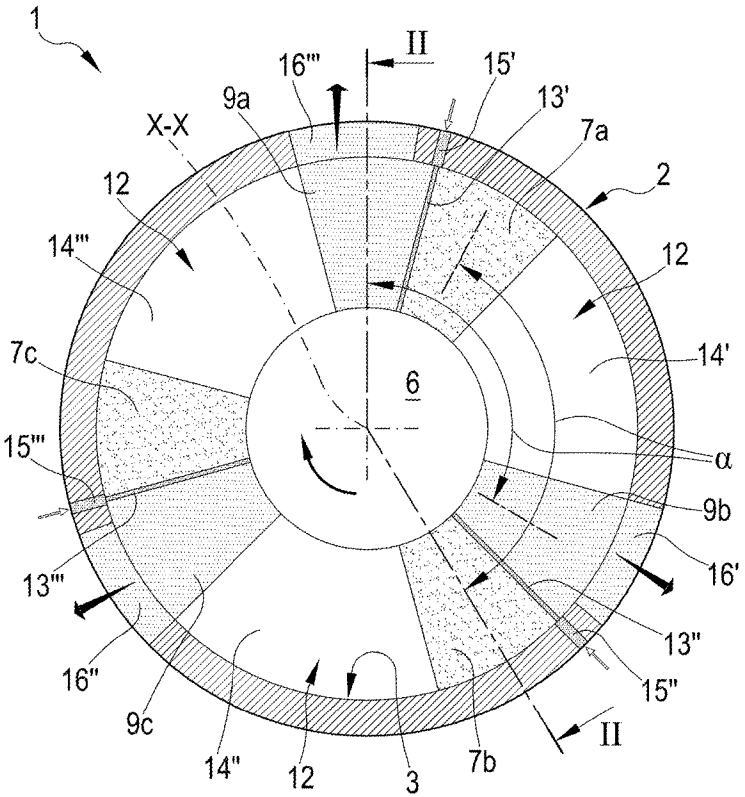
FIG. 1 shows a schematic front view of a drive unit according to the present invention.
Figure 3:
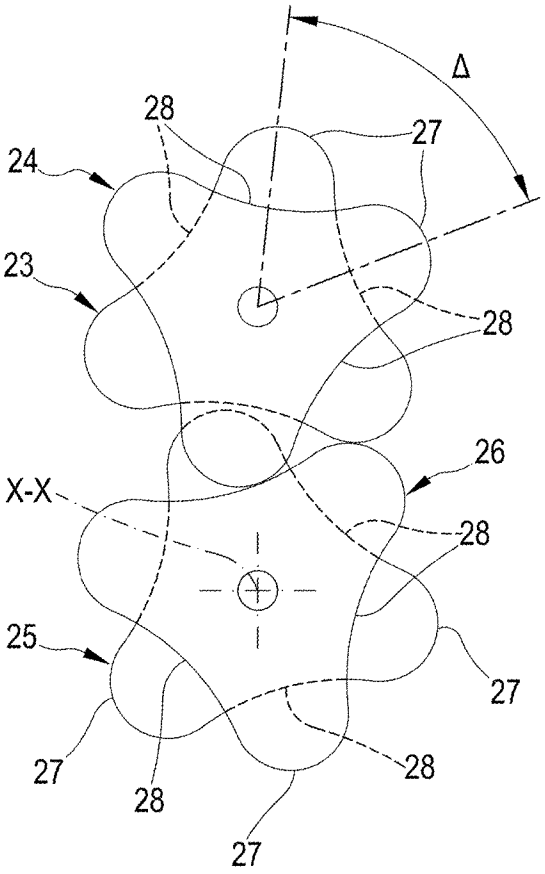
FIG. 3 illustrates a front view of the train of three-lobe gears belonging to the motion transmission system.
Figure 2B:
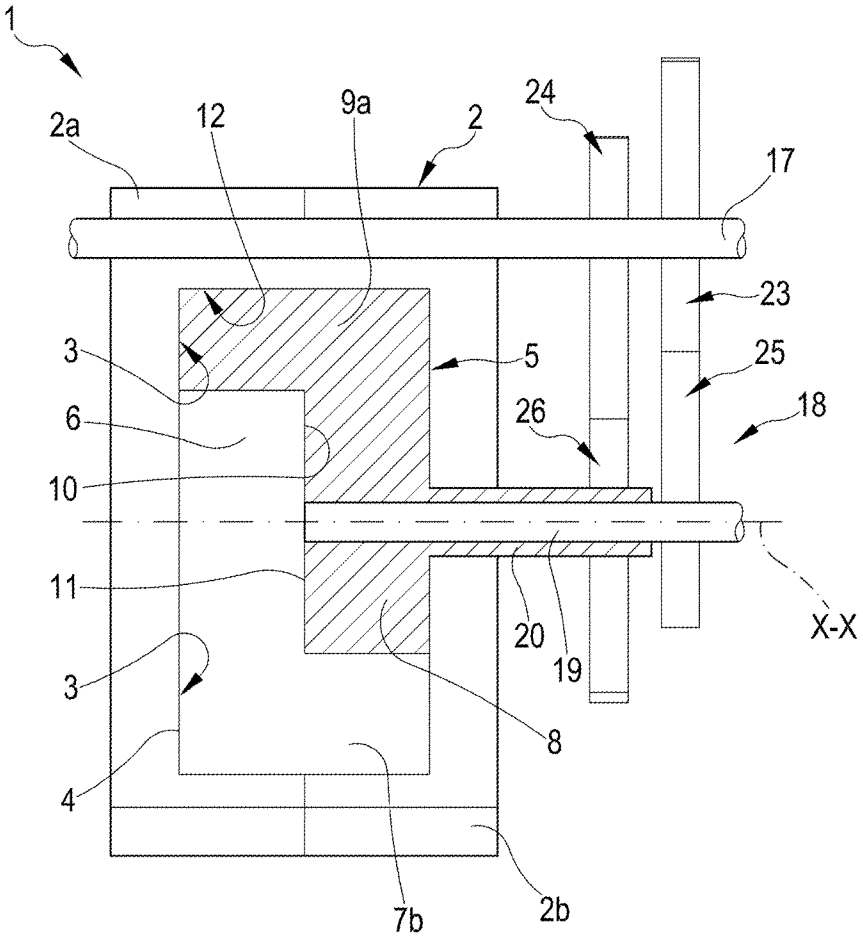
FIG. 2*b* is a side sectional view of a variant of the central body of the drive unit in FIG. 1, with a section of the motion transmission system.

With reference to FIGS. 1, 2*a*, 2*b*, 1 denotes overall a "drive unit", the main subject matter of the present inventive idea, used as an "expander" in closed-circuit heat cycles of the Rankine type operating with "organic fluids", as an "expander" in closed-circuit heat cycles of the Rankine and Rankine-Hirn type, operating with steam, as a "compressor/expander" in open-circuit heat cycles of the Brayton type operating with hot air, as a "compressor/expander" in closed-circuit heat cycles of the Stirling type operating with hot air (in reality nitrogen, helium, hydrogen, etc.), or else directly utilizable as a "hydraulic motor", "pneumatic motor", "pneumatic compressor", "volumetric pump" and in many other applications that can exploit the particular motor features thereof.

The drive unit 1 comprises a casing 2 which internally delimits a seat 3.

In the non-limiting embodiment illustrated, the casing 2 is formed by two half-parts 2*a*, 2*b* joined together.

Housed in the seat 3 there is a first rotor 4 and a second rotor 5, which rotate around a same axis "X-X".

The first rotor 4 has a first cylindrical body 6 and three first elements 7*a*, 7*b*, 7*c* which extend radially from the first cylindrical body 6 and are rigidly connected or integral therewith.

The second rotor 5 has a second cylindrical body 8 and three second elements 9*a*, 9*b*, 9*c* which extend radially from the second cylindrical body 8 and are rigidly connected or integral therewith.

The elements 7*a*, 7*b*, 7*c* of the rotor 4 are angularly equidistant from one another, i.e. each element is spaced apart from the adjacent element by an angle "α" of 120° (measured between the planes of symmetry of each element).

The elements 9*a*, 9*b*, 9*c* of the rotor 5 are angularly equidistant from one another, i.e. each element is spaced apart from the adjacent element by an angle "α" of 120° (measured between the planes of symmetry of each element).

The first and second cylindrical bodies 6, 8 are set side by side on respective bases 10, 11 and are coaxial.

The three first elements 7*a*, 7*b*, 7*c* of the first rotor 4 moreover extend along an axial direction and have a projecting portion disposed in a position that is radially external to the second cylindrical body 8 of the second rotor 5.

The three second elements 9*a*, 9*b*, 9*c* of the second rotor 5 moreover extend along an axial direction and have a projecting portion disposed in a position that is radially external to the first cylindrical body 6 of the first rotor 4.

The three first elements 7*a*, 7*b*, 7*c* are alternated with the three second elements 9*a*, 9*b*, 9*c* along the circumferential extension of the annular chamber 12.

Each of the first and second elements 7*a*, 7*b*, 7*c*, 9*a*, 9*b*, 9*c* has, in a radial section (FIG. 1), a substantially trapezoidal profile which converges toward the rotation axis "X-X" and, in a axial section (FIG. 2*a*,2*b*), a substantially circular or rectangular profile.

Each of the first and second elements 7*a*, 7*b*, 7*c*, 9*a*, 9*b*, 9*c* has an angular size, given purely by way of approximation and not by way of limitation, of about 38°.

Peripheral surfaces that are radially external to the first and second cylindrical bodies 6, 8 delimit, together with an inner surface of the seat 3, an annular chamber 12.

The annular chamber 12 is therefore divided into variable-volume "rotating chambers" 13', 13", 13'", 14', 14", 14'" by the first and second elements 7*a*, 7*b*, 7*c*, 9*a*, 9*b*, 9*c*. In particular, each variable-volume "rotating chamber" is delimited (besides by the surface radially internal to the casing 2 and the surface radially external to the cylindrical bodies 6, 8) by one of the first elements 7*a*, 7*b*, 7*c* and one of the second elements 9*a*, 9*b*, 9*c*.

In the first FIG. 2*a*, each of the first and second elements 7*a*, 7*b*, 7*c*, 9*a*, 9*b*, 9*c* has, in an axial section thereof, a substantially circular profile and the annular chamber 12 likewise has a circular cross section defined as "toroidal".

In the variant in FIG. 2*b*, each of the first and second elements 7*a*, 7*b*, 7*c*, 9*a*, 9*b*, 9*c* has, in a axial section thereof, a rectangular (or square) profile and the annular chamber 12 likewise has a rectangular (or square) cross section.

Between inner walls of the annular chamber 12 and each of the aforesaid first and second elements 7*a*, 7*b*, 7*c*, 9*a*, 9*b*, 9*c* there remains a gap such as to permit the rotational movement of the pistons 4, 5 and sliding of the elements 7*a*, 7*b*, 7*c*, 9*a*, 9*b*, 9*c* in the chamber 12 itself.

The first and second elements 7*a*, 7*b*, 7*c*, 9*a*, 9*b*, 9*c* are the pistons of the drive unit 1 illustrated and the variable-volume rotating chambers 13', 13", 13'", 14', 14", 14' are the chambers for the compression and/or expansion of the working fluid of the aforesaid drive unit 1.

The inlet or discharge openings 15', 16', 15", 16", 15', 16'" (of suitable size and shape) are fashioned in a wall radially external to the casing 2; they open into the annular chamber 12 and are in fluid communication with conduits external to the annular chamber 12, illustrated further below.

Each inlet or discharge opening 15', 16', 15", 16", 15'", 16' is angularly spaced in an appropriate way so as to adapt to the requirements of each different individual functional configuration of the drive unit 1.

The drive unit 1 further comprises a primary shaft 17 parallel to and distanced from the rotation axis "X-X" and rotatably mounted on the casing 2 and a transmission 18 mechanically interposed between the primary shaft 17 and the rotors 4, 5.

The transmission 18 comprises a first auxiliary shaft 19 onto which the first rotor 4 is keyed and a second auxiliary shaft 20 onto which the second rotor 5 is keyed. The first and second auxiliary shafts 19, 20 are coaxial with the rotation axis "X-X". The second auxiliary shaft 20 is tubular and houses within it a portion of the first auxiliary shaft 19. The first auxiliary shaft 19 can rotate in the second auxiliary shaft 20 and the second auxiliary shaft 20 can rotate in the casing 2.

A first three-lobe gear 23 is keyed onto the primary shaft 17. A second three-lobe gear 24 is keyed onto the primary shaft 17 next to the first. The second three-lobe gear 24 is mounted on the primary shaft 17 angularly offset relative to the first three-lobe gear 23 by an angle "Δ" of 60°. The two three-lobe gears 23 and 24 rotate together jointly with the primary shaft 17.

A third three-lobe gear 25 is keyed onto the first auxiliary shaft 19 (so as to rotate integrally therewith) and the teeth thereof precisely enmesh with the teeth of the first three-lobe gear 23.

A fourth three-lobe gear 26 is keyed onto the second auxiliary shaft 20 (so as to rotate integrally therewith) and the teeth thereof precisely enmesh with the teeth of the second three-lobe gear 24.

Each of the above-mentioned three-lobe gears 23, 24, 25, 26 has approximately the profile of an equilateral triangle with rounded vertices 27 and connecting portions 28, interposed between the vertices 27, which can be concave, flat or convex.

Changing the shape of the vertices 27 and connecting portions 28 of the gears makes it possible to pre-establish the value of the angular periodic movement of the auxiliary shafts 19, 20 during their rotary motion.

The structure of the transmission 18 is such that during a complete revolution of the primary shaft 17 the two rotors 4, 5 also carry out a complete revolution, but with periodically variable angular velocities, offset from each other, which induce the adjacent pistons 7*a*, 9*a*; 7*b*, 9*b*; 7*c*, 9*c* to move away and toward one another three times during a complete 360° revolution. Therefore, each of the six variable-volume chambers 13', 13", 13'", 14', 14", 14'" expands three times and contracts three times at each complete revolution of the primary shaft 17.

In others words, pairs of adjacent pistons of the six pistons 7*a*, 7*b*, 7*c*; 9*a*, 9*b*, 9*c* are movable, during their rotation at a periodically variable angular velocity in the annular chamber 12, between a first position, in which the two faces of the adjacent pistons lie substantially next to each other, and a second position, in which the same faces are angularly spaced apart by the maximum allowed. Purely by way of example, in the first position the two faces of the adjacent pistons are angularly spaced apart by about 1°, whereas in the second position the two same faces are angularly spaced apart by about 81°.

The six variable-volume chambers 13', 13", 13', 14', 14", 14'" are made up of a first group of three chambers 13', 13", 13'" and a second group of three chambers 14', 14", 14'. When the three chambers 13', 13", 13' of the first group have the minimum volume (pistons next to each other at the minimum reciprocal distance) the other three chambers 14', 14", 14'" (of the second group) have the maximum volume (pistons at the maximum reciprocal distance).

Detailed Description of a First Application of the Drive Unit 1.

Figure 4:
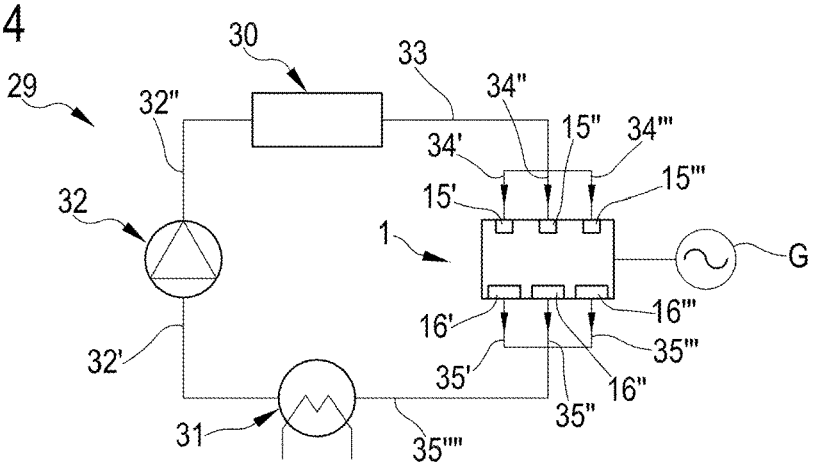
FIG. 4 illustrates a first diagram of a heat engine comprising the drive unit according to the present invention.

With reference to FIGS. 1 and 4, the heat engine 29 is configured so as to function with a Rankine heat cycle, which uses deionized, dimineralized and degassed water as the thermal fluid, but could also use any other fluid suited to the purpose.

This solution has the following particularities:

- the generator 30 transforms the water into saturated steam (at the pre-established pressure/temperature);
- the steam, travelling through the conveying conduits 33, 34', 34", 34'" and passing through the three inlet openings 15', 15", 15'", flows into in the drive unit 1 (or volumetric expander) and enters the three corresponding expansion chambers 13', 13", 13'";
- in the expansion chambers 13', 13", 13'", the steam can expand, causing the pistons to rotate and producing useful work (which, in this specific case, is used by the generator G to produce electricity);
- at the end of expansion, the spent steam is expelled (at a low pressure/temperature) through the three discharge openings 16', 16", 16'" and the associated conveying conduits 35', 35", 35'", 35"" and conveyed toward the condenser 31, where it is condensed and transformed into water (recovering heat that is useful for any purpose);
- the condensate water travels in the conveying conduit 32' and, via the pump 32 and after passing through the conduit 32", it is pumped (at a high pressure) back into the generator 30, thus assuring the continuity of the closed-circuit cycle.

In this configuration there is a perfect thermodynamic and kinematic balancing of all moving parts, so that the volumetric expander can also operate at a very high speed, without vibrations or noise.

Detailed Description of a Second Application of the Drive Unit 1.

Figure 5:
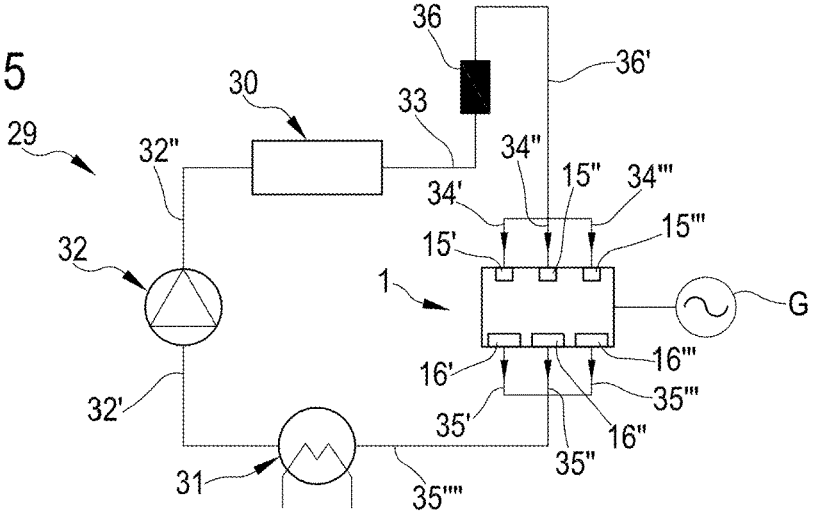
FIG. 5 illustrates a second diagram of a heat engine comprising the drive unit according to the present invention.

With reference to FIGS. 1 and 5, the heat engine 29 is configured so as to function with a Rankine-Him heat cycle, which uses deionized, dimineralized and degassed water as the thermal fluid, but could also use any other fluid suited to the purpose.

This solution has the following particularities:

- the generator 30 transforms the water into saturated steam (at the pre-established pressure/temperature);
- the steam flows via the conveying conduit 33 into the superheater 36 and while travelling therethrough undergoes superheating (at a constant pressure) and then, via suitable conveying conduits 36', 34', 34", 34'" and on passing through the three inlet openings 15', 15", 15'", it flows into the drive unit 1 (or volumetric expander) and enters the three corresponding expansion chambers 13', 13", 13'";
- in the expansion chambers 13', 13", 13'", the steam can expand, causing the pistons to rotate and producing useful work (which, in this specific case, is used by the generator G to produce electricity);
- at the end of expansion, the spent steam is expelled (at a low pressure/temperature) through the three discharge openings 16', 16", 16'" and the associated conveying conduits 35', 35", 35'", 35"" and conveyed toward the condenser 31, where it is condensed and transformed into water (recovering heat that is useful for any purpose);
- the condensate water flows through the conveying conduit 32' and, via the pump 32 and after passing through the conduit 32", it is pumped (at a high pressure) back into the generator 30, thus assuring the continuity of the closed-circuit cycle.

In this configuration there is a perfect thermodynamic and kinematic balancing of all moving parts, so that the volumetric expander can also operate at a very high speed, without vibrations or noise.

Detailed Description of a Third Application of the Drive Unit 1.

Figure 6:
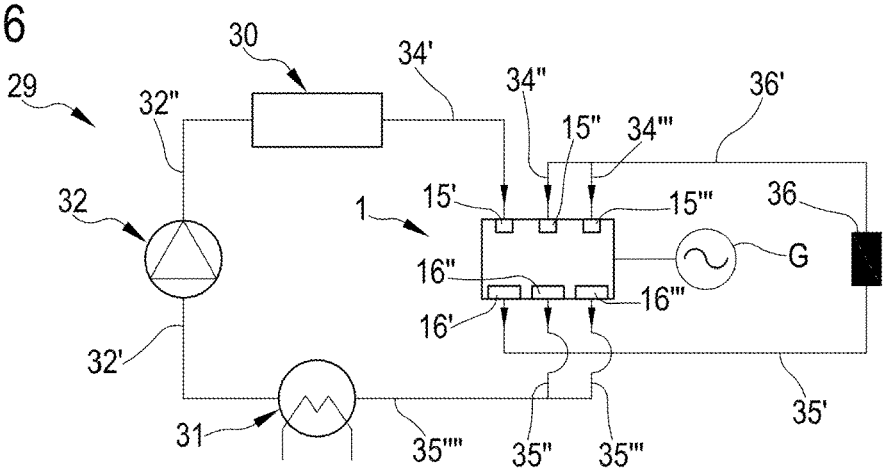
FIG. 6 illustrates a third diagram of a heat engine comprising the drive unit according to the present invention.

With reference to FIGS. 1 and 6, the heat engine 29 is configured so as to function with a Rankine-Hirn heat cycle, which uses deionized, dimineralized and degassed water as the thermal fluid.

This solution has the following particularities:

- the generator 30 transforms the water into saturated steam (at the pre-established pressure/temperature);
- the steam flows via the conveying conduit 34' and passes through the inlet opening 15' into the drive unit 1 (or volumetric expander) and enters the corresponding first expansion chamber 13';
- in the expansion chamber 13', the steam can expand, causing the pistons to rotate and producing a part of useful work (which, in this specific case, is used by the generator G to produce electricity);
- at the end of expansion in the first chamber 13', the spent steam is expelled (at a medium pressure/temperature) through the discharge opening 16' and the associated conveying conduit 35' and conveyed toward the superheater 36 in which it is superheated (at a constant pressure) and then, via suitable conveying conduits 36', 34", 34'" and the corresponding inlet openings 15" and 15'", it enters the corresponding second and third expansion chamber 13" and 13'";
- in the expansion chambers 13" and 13'", the steam can expand, causing the pistons to rotate and producing another part of useful work (which, in this specific case, is used by the generator G to produce electricity);
- at the end of expansion, the spent steam is expelled (at a low pressure/temperature) through the two discharge openings 16",16'" and the associated conveying conduits 35", 35'", 35"" and conveyed toward the condenser 31, where it is condensed and transformed into water (recovering heat usable for any purpose);
- the condensate water travels through the conveying conduit 32' and, via the pump 32 and after passing through the conduit 32", it is pumped (at a high pressure) back into the generator 30, thus assuring the continuity of the closed-circuit cycle.

Detailed Description of a Fourth Application of the Drive Unit 1.

Figure 7:
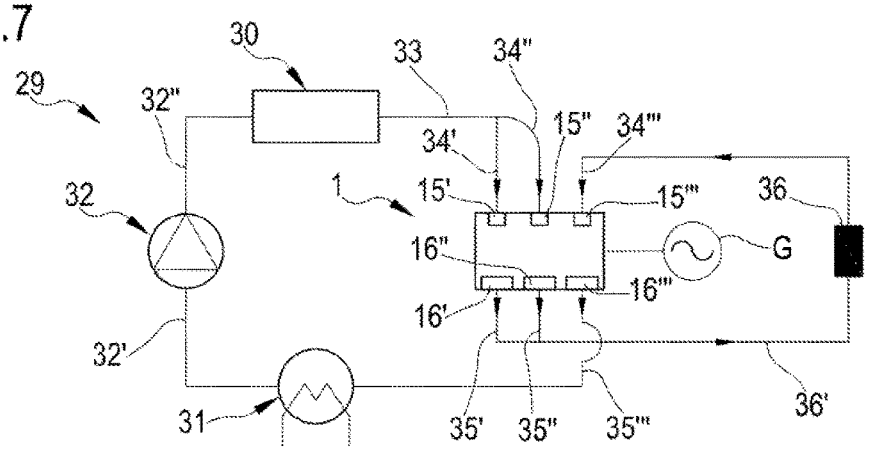
FIG. 7 illustrates a fourth diagram of a heat engine comprising the drive unit according to the present invention.

With reference to FIGS. 1 and 7, the heat engine 29 is configured so as to function with a Rankine-Hirn heat cycle, which uses deionized, dimineralized and degassed water as the thermal fluid.

This solution has the following particularities:

- the generator 30 transforms the water into saturated steam (at the pre-established pressure/temperature);
- the steam flows via the conveying conduits 33, 34', 34" and passes through the inlet openings 15',15" into the drive unit 1 (or volumetric expander) and enters the corresponding first and second expansion chambers 13',13";
- in the expansion chambers 13' and 13", the steam can expand, causing the pistons to rotate and producing a part of useful work (which, in this specific case, is used by the generator G to produce electricity);
- at the end of expansion, the spent steam is expelled through the discharge openings 16',16" and the associated conveying conduits 35', 35", 36' (at a medium pressure/temperature) and conveyed toward the superheater 36, in which it is superheated (at a constant pressure) and then, via the conveying conduit 34'" and the corresponding inlet opening 15'", conveyed into the corresponding third expansion chamber 13'";
- in the expansion chamber 13'", the steam can expand, causing the pistons to rotate and producing another part of useful work (which, in this specific case, is used by the generator G to produce electricity);
- at the end of expansion, the spent steam is expelled (at a low pressure/temperature) through the discharge opening 16'" and the associated conveying conduit 35'" and conveyed toward the condenser 31, where it is condensed and transformed into water (recovering heat usable for any purpose);
- the condensate water travels through the conveying conduit 32' and, via the pump 32 and after passing through the conduit 32", it is pumped (at a high pressure) back into the generator 30, thus assuring the continuity of the closed-circuit cycle.

Detailed Description of a Fifth Application of the Drive Unit 1.

Figure 8:
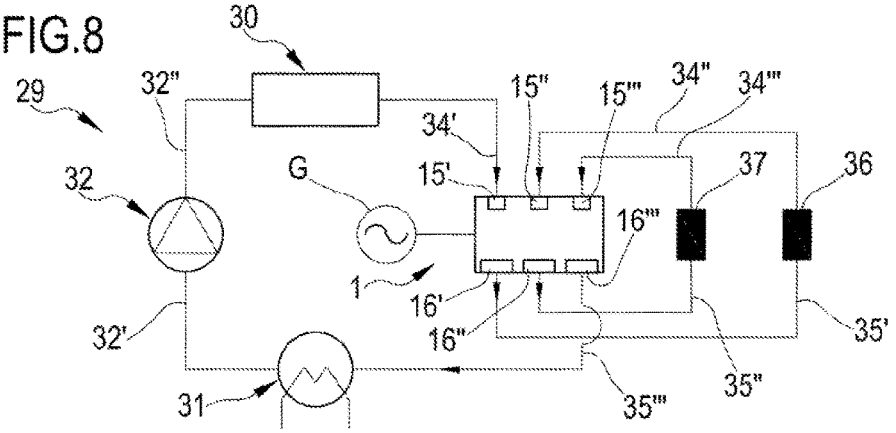
FIG. 8 illustrates a fifth diagram of a heat engine comprising the drive unit according to the present invention.
Figure 9:
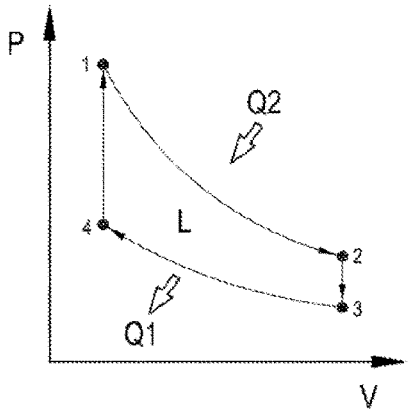
FIG.9 (PRIOR ART)
FIG. 9 represents the pressure-volume diagram of a generic Stirling thermal cycle.

With reference to FIGS. 1 and 8, the heat engine 29 is configured so as to function with a Rankine-Hirn heat cycle with double superheating, which uses deionized, dimineralized and degassed water as the thermal fluid.

This solution has the following particularities:

the generator 30 transforms the water into saturated steam (at the pre-established pressure/temperature);

the steam flows via the conveying conduit 34' and passes through the inlet opening 15' into the drive unit 1 (or volumetric expander) and enters the corresponding first expansion chamber 13';

in the expansion chamber 13', the steam can expand, causing the pistons to rotate and producing a part of useful work (which, in this specific case, is used by the generator G to produce electricity);

at the end of expansion, the spent steam is expelled (at a medium pressure/temperature) through the discharge opening 16' and the associated conveying conduit 35' and conveyed toward the superheater 36, in which it is superheated (at a constant pressure) and then, via the conveying conduit 34" and the corresponding inlet opening 15", conveyed into the corresponding second expansion chamber 13";

in the expansion chamber 13", the steam can expand, causing the pistons to rotate and producing another part of useful work (which, in this specific case, is used by the generator G to produce electricity);

at the end of expansion, the spent steam is expelled (at a medium pressure/temperature) through the discharge opening 16" and the associated conveying conduit 35" and conveyed toward the superheater 37 in which it is superheated (at a constant pressure) and then, via the conveying conduit 34'" and the corresponding inlet opening 15'", conveyed into the corresponding third expansion chamber 13'";

in the expansion chamber 13'", the steam can expand, causing the pistons to rotate and producing another part of useful work (which, in this specific case, is used by the generator G to produce electricity);

at the end of expansion, the spent steam is expelled (at a low pressure/temperature) through the discharge opening 16'" and the associated conveying conduit 35'" and conveyed toward the condenser 31, where it is condensed and transformed into water (recovering heat usable for any purpose);

the condensate water travels through the conveying conduit 32' and, via the pump 32 and after passing through the conduit 32", it is pumped (at a high pressure) back into the generator 30, thus assuring the continuity of the closed-circuit cycle.

Figure 13:
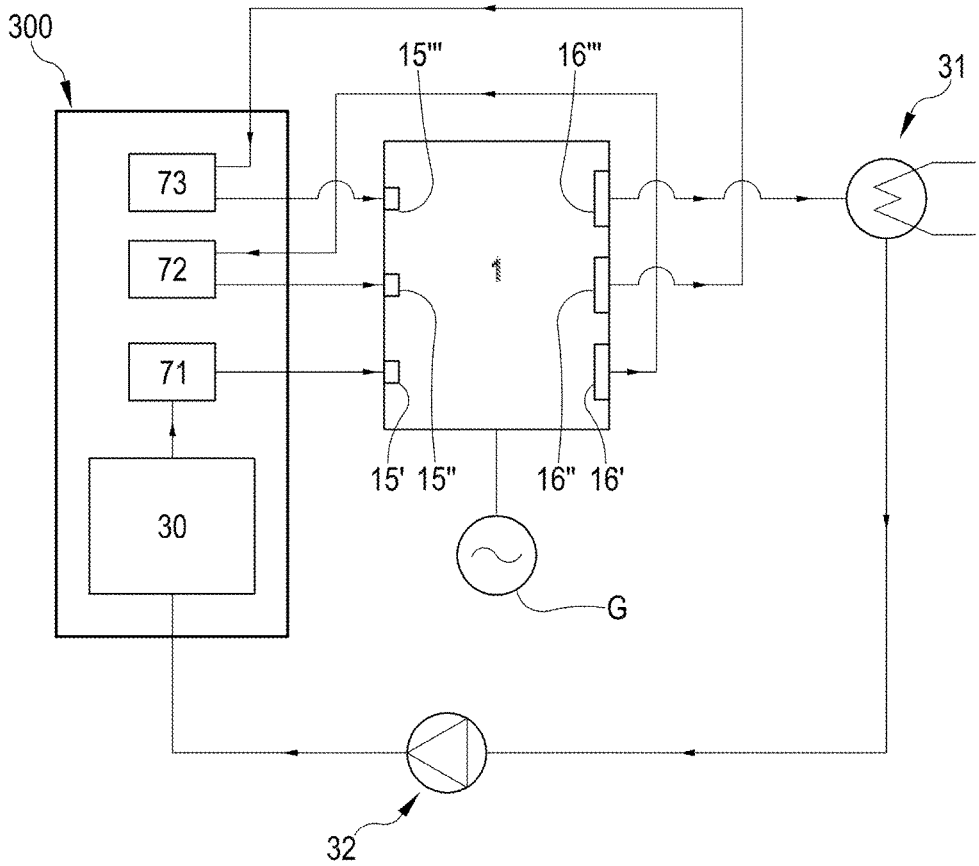
FIG. 13 illustrates a further possible diagram of a heat engine comprising the drive unit according to the present invention.

FIG. 13 illustrates a further possible layout of a heat engine according to the present invention. This layout is similar to the one shown in the diagrams of FIGS. 4-8, the difference being that the elements making up the heat engine are reconfigured in such a way as to enable the production of saturated steam and superheating of steam to be managed through a single apparatus.

As shown by way of example in the diagram of FIG. 13, the heat engine 29 can be provided with a heating apparatus 300 (or burner) comprising:

the aforesaid steam generator 30, disposed upstream of the drive unit and configured so as to transform the water into saturated steam to be supplied to the drive unit in order to rotate the rotors;

a first superheater 71 (corresponding to the superheater 36 in FIG. 5) interposed between the steam generator and the inlet opening 15' of the drive unit, via which the superheated steam flows into the first expansion chamber of the drive unit;

a second superheater 72 (corresponding to the superheater 36 in FIG. 8) interposed between the discharge opening 16' of the drive unit, from which steam is output at the end of expansion in the first chamber, and the inlet opening 15" of the drive unit; the second superheater is configured so as to receive the spent steam (at a medium pressure/temperature) expelled by the first expansion chamber and superheated (at a constant pressure), in such a way that the superheated steam flows via the inlet opening 15" into the second expansion chamber of the drive unit;

a third superheater 73 (corresponding to the superheater 37 in FIG. 8) interposed between the discharge opening 16" of the drive unit, from which steam is output at the end of expansion in the second chamber, and the inlet opening 15'" of the drive unit; the second superheater is configured so as to receive the spent steam (at a medium pressure/temperature) expelled by the second expansion chamber and superheated (at a constant pressure), in such a way that the superheated steam flows via the inlet opening 15'" into the third expansion chamber of the drive unit.

The heating apparatus 300 (or burner) is configured so as to manage both the generation of steam and the various superheating steps present in the heat engine. To this end the heating apparatus has a vertical structure, in which, from bottom to top, the steam generator 30, the first superheater 71, the second superheater 72 and the third superheater 73 are located.

The heating apparatus 300 comprises suitable conveying conduits which connect the inlet and discharge openings of the drive unit to the superheaters present in the heating apparatus.

The heat engine in FIG. 13 is configured so as to function with a Rankine-Hirn heat cycle with triple superheating, which uses deionized, dimineralized and degassed water as the thermal fluid.

Figure 14:
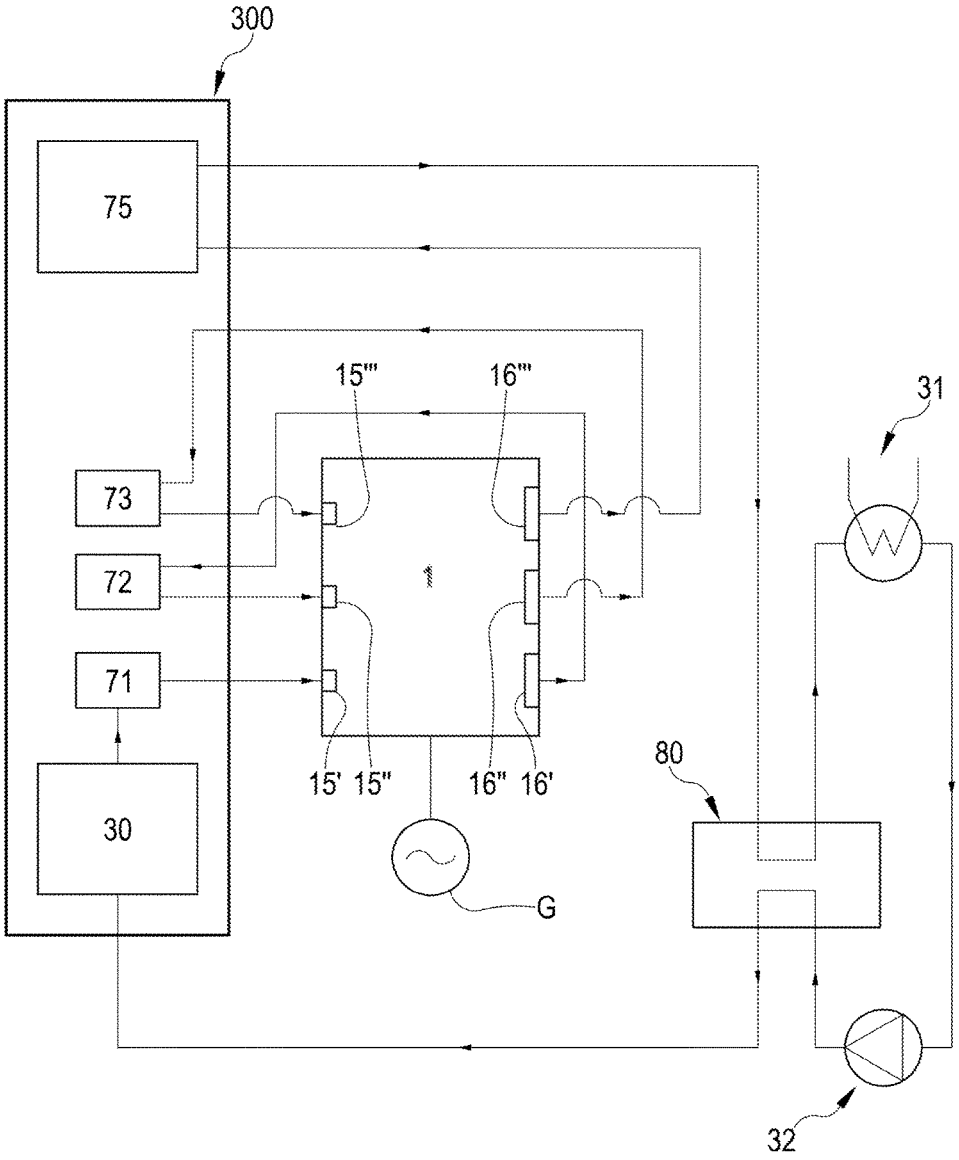
FIG. 14 illustrates a further possible diagram of a heat engine comprising the drive unit according to the present invention.

FIG. 14 illustrates a further possible layout of a heat engine according to the present invention. This layout is similar to the one shown in the diagram of FIG. 13, with the addition of a fume temperature reducer 75 and regenerator 80.

In this embodiment, the heat engine comprises a regenerator 80, interposed between the discharge opening 16'" of the drive unit, from which the spent steam is expelled (at a low pressure/temperature) at the end of expansion in the third chamber, and the condenser 31, where the steam is condensed and transformed into water, thus recovering heat.

The regenerator 80 is configured so as to receive the steam expelled from the drive unit at the end of expansion in the third chamber, and exchange the residual heat from the steam with the flow of water downstream of the condenser 31, pumped (at a high pressure) by the pump 32 back toward the generator 30, thereby assuring the continuity of the closed-circuit cycle.

According to the embodiment in FIG. 14, the heating apparatus 300 (or burner) comprises, operatively downstream of the superheaters 71, 72 and 73, a fume temperature reducer 75: this reducer is configured so as to extract heat from the fumes produced by the heating apparatus, thus recovering it. The reducer 75 is interposed between the discharge opening 16'" of the drive unit, from which the spent steam is expelled (at a low pressure/temperature) at the end of expansion in the third chamber, and the regenerator 80, in which the steam exchanges its residual heat with the flow of condensate water directed back to the generator 30, where the cycle starts again. Essentially, the fume temperature reducer 75 receives as input the spent steam output by the drive unit, exchanges heat with the fumes of the burner, thereby increasing the temperature of the steam, and outputs the heated steam directed to the regenerator 80. In this manner, the steam output by the drive unit arrives at the regenerator 80 with a higher temperature, thanks to the exchange of heat that takes place in the reducer 75, where the steam recovers heat thanks to the fumes.

Detailed Description of a Sixth Application of the Drive Unit 1.

Figure 10:
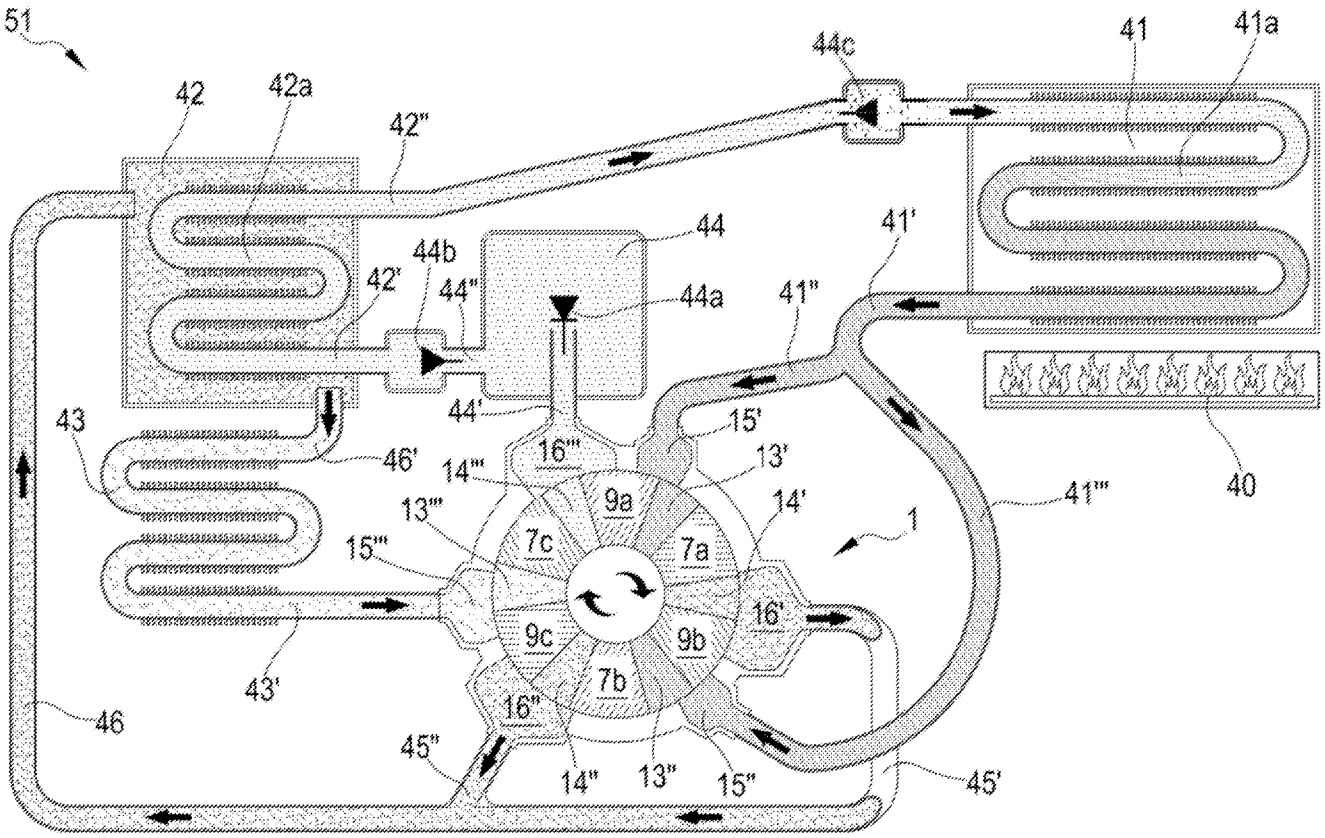
FIG. 10 illustrates a diagram of a six-piston "heat engine" using the drive unit with the new "pulsating heat cycle" according to the present inventive idea.

With reference to FIG. 10, in order to describe the functions of the new "pulsating heat cycle" according to the present inventive idea, it is necessary to start off by noting that in the drive unit 1, in each of the six periodically variable-volume chambers 13', 13", 13''', 14', 14", 14''' (each delimited by the two pistons adjacent to each other and rotating inside the annular cylinder), the diversified intake, compression, expansion and expulsion functions are performed periodically.

For the sake of simplicity, in the following description, the path followed by the thermal fluid in the different sections of the heat engine 51 will be explained as if a single complete heat cycle were involved. In reality, for each revolution angle of 60° of the drive shaft (with a total revolution angle of 360°) no fewer than six complete heat cycles are carried out.

Every heat cycle, in its complete form (apart from start-up), is carried out continuously in the following phases of thermodynamic variation of the fluid: intake of the cooled fluid, compression of the fluid taken in, accumulation of the compressed fluid, preheating of the compressed fluid, superheating of the compressed-preheated fluid, expansion of the superheated fluid (and corresponding production of useful work), expulsion of the spent fluid, recovery of heat energy from the spent fluid and cooling of the spent fluid (with possible recovery of heat for different uses), as described below.

With reference to FIGS. 2*b*,10, in an application of the drive unit 1 (with six pistons), illustrated purely by way of non-limiting example, the heat engine 51 according to the present inventive idea is configured so as to operate with the new "pulsating heat cycle" using any thermal fluid suited to the purpose (for example: air, nitrogen, helium, hydrogen, etc).

The heat engine 51 is started up in the following manner:

- the burner 40 is activated and, via the heater 41, heats the thermal fluid contained in the serpentine 41*a* up to a preset minimum temperature;
- when the thermal fluid contained in the serpentine 41*a* has reached the preset minimum temperature, the primary shaft 17 and the whole transmission system which moves the six pistons 7*a*, 7*b*, 7*c*, 9*a*, 9*b*, 9*c* are made to start rotating by a specific "starter" (not represented in the figure, but which could also be the same electric generator connected to the primary shaft 17 of the drive unit 1), thereby creating the preliminary condition for initiating the cycle;
- at this point the burner 40 is activated and, via the heater 41, heats the thermal fluid contained in the serpentine 41*a* up to a preset maximum temperature, thereby creating the conditions for the start-up and normal, continuous operation of the heat engine 51.

With reference to FIG. 10, in the position in which the pistons are located, the following main phases can be identified:

Phase of Intake of the Cooled Thermal Fluid.

On leaving the cooler 43, the thermal fluid travels through the conduit 43' and after passing through the intake opening 15''', is drawn into the chamber 13''' as result of the movement away of the two pistons 9*c*-7*c*.

Phase of Compression of the Thermal Fluid Taken in.

As the two pistons 7*c*-9*a* move nearer, the thermal fluid (taken in during the previous cycle) is compressed and the temperature thereof increases.

Phase of Accumulation of the Compressed Thermal Fluid.

The compressed fluid, after passing through the discharge opening 16''', the conduit 44' and the check valve 44*a*, is conveyed into the compensating tank 44, where it remains available for immediate use in the subsequent phases.

Phase of Preheating of the Compressed Thermal Fluid.

When, as a result of the input of the heated thermal fluid into the chambers 13'-13", the pressure of the thermal fluid circulating in the serpentine 41*a* falls below that of the compensating tank 44, the fluid, after passing through the check valve 44*b*, flows through the conduit 44" and, whilst travelling through the entire serpentine 42*a* in the section 42'-42", acquires heat energy from the regenerator 42 until arriving at the heating serpentine 41*a*.

The heat engine 51 can comprise, in addition or as an alternative to the check valve 44*b*, a check valve 44*c*, interposed between the outlet 42" of the serpentine 42*a* and the inlet of the heating serpentine 41*a*.

Phase of Superheating of the Compressed-Preheated Thermal Fluid.

The burner 40 (fed with any type of fuel) supplies heat energy to the heater 41 (which, instead of the burner 40, can also use other heat sources: solar energy, residual energy from industrial processes, etc.), so that on passing through the entire serpentine 41*a*, the compressed-preheated thermal fluid undergoes a rapid increase in temperature and pressure.

Phase of Expansion of the Superheated Thermal Fluid.

When the pistons 7*a*-7*b*, rotating in the annular cylinder in the direction of motion indicated by the arrows, open the inlet openings 15'-15" (thus also performing a valve function), the superheated thermal fluid, after travelling through the conduits 41'-41"-41", enters the expansion chambers 13' and 13", in which it can expand, causing the pistons to rotate and producing useful work (which may be used to produce electricity or for any other purpose).

Phase of Expulsion of the Spent Thermal Fluid.

As the pistons 7*a*-9*b* and 7*b*-9*c* move nearer, the chambers 14' and 14" are reduced in volume and the spent thermal fluid (already expanded in the previous cycle), after passing through the two discharge openings 16'-16" and through the conduits 45'-45"-46, is expelled from the drive unit 1 toward the regenerator 42.

Phase of Recovery of Heat Energy from the Spent Thermal Fluid.

The spent thermal fluid expelled from the drive unit 1, while passing through the regenerator 42, transfers thereto part of the heat energy still possessed and thus undergoes a first cooling.

Phase of Cooling of the Spent Fluid.

The thermal fluid leaving the regenerator 42 travels through the conduit 46' and, while passing through the cooler 43, transfers thereto another part of heat energy (which can also be recovered and used for any useful purpose) and then undergoes a second cooling, thus ending up in ideal conditions for the continuity of the cycle.

Detailed Description of the Use of the New "Pulsating Heat Cycle" with an Already Known Drive Unit 1 (with Four Pistons).

Figure 11:
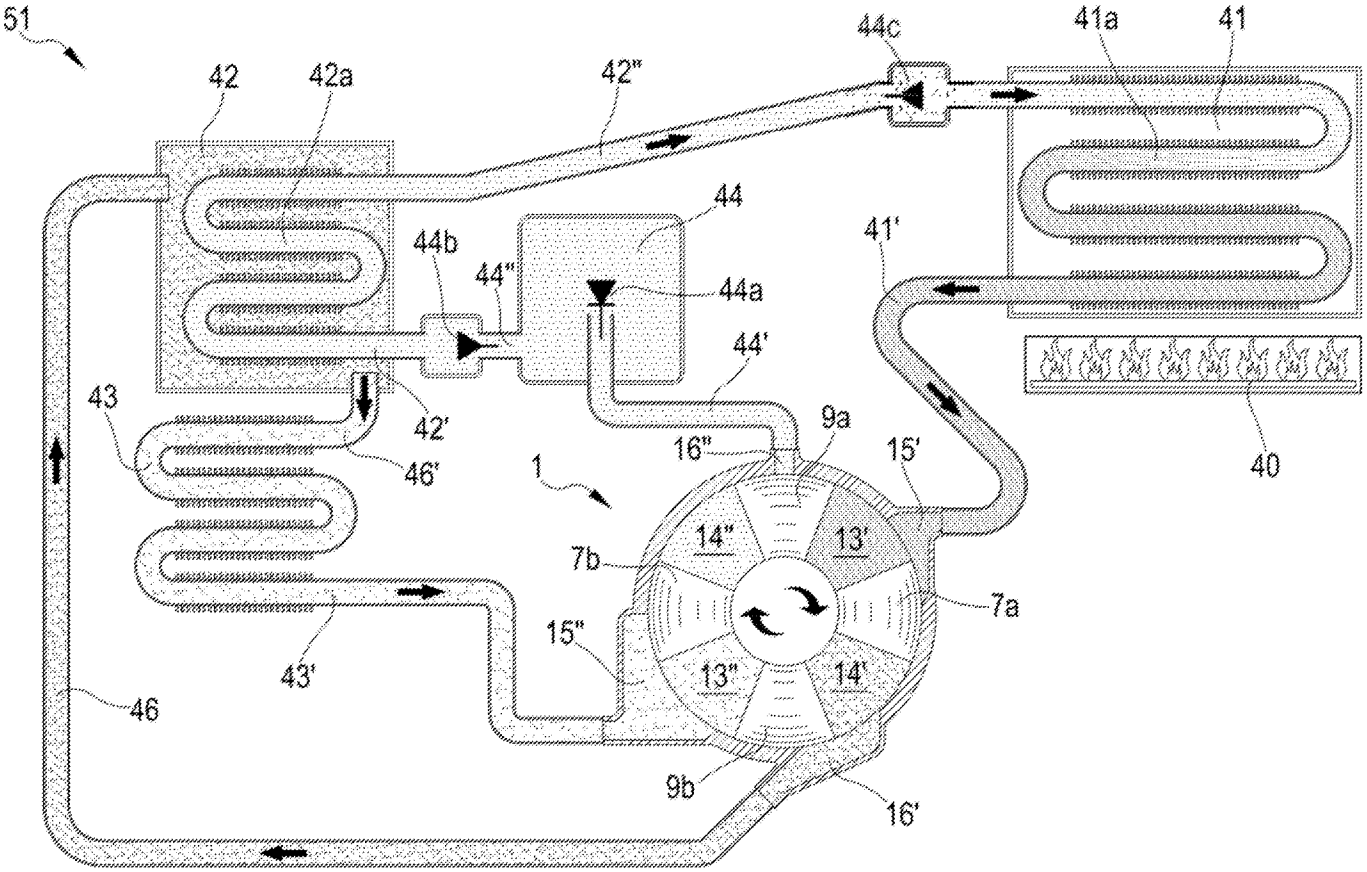
FIG. 11 illustrates a diagram of a four-piston "heat engine" using the new "pulsating heat cycle" according to the present inventive idea.

With reference to FIG. 11, in order to describe the functions of the new "pulsating heat cycle" according to the present inventive idea, it is necessary to start off by noting that in the drive unit 1, in each of the four periodically variable-volume chambers 13', 13", 14', 14" (each delimited by the two pistons adjacent to each other and rotating inside the annular cylinder), the diversified intake, compression, expansion and expulsion functions are performed periodically.

For the sake of simplicity, in the following description, the path followed by the thermal fluid in the different sections of the heat engine 51 will be explained as if a single complete heat cycle were involved. In reality, for each revolution angle of 90° of the drive shaft (with a total revolution angle of 360°) four complete heat cycles are carried out.

Every heat cycle, in its complete form (apart from start-up), is carried out continuously in the following phases of thermodynamic variation of the fluid: intake of the cooled fluid, compression of the fluid taken in, accumulation of the compressed fluid, preheating of the compressed fluid, superheating of the compressed-preheated fluid, expansion of the superheated fluid (and corresponding production of useful work), expulsion of the spent fluid, recovery of heat energy from the spent fluid and cooling of the spent fluid (with possible recovery of heat for different uses), as described below.

With reference to FIGS. 2*b*,11, in an application of the drive unit 1 (with four pistons), illustrated purely by way of non-limiting example, the heat engine 51 according to the present inventive idea is configured so as to operate with the new "pulsating heat cycle" using any thermal fluid suited to the purpose (for example: air, nitrogen, helium, hydrogen, etc).

The heat engine 51 is started up in the following manner:

- the burner 40 is activated and, via the heater 41, heats the thermal fluid contained in the serpentine 41*a* up to a preset minimum temperature;
- when the thermal fluid contained in the serpentine 41*a* has reached the preset minimum temperature, the primary shaft 17 and the whole transmission system which moves the six pistons 7*a*, 7*b*, 7*c*, 9*a*, 9*b*, 9*c* are made to start rotating by a specific "starter" (not represented in the figure, but which could also be the same electric generator connected to the primary shaft 17 of the drive unit 1), thereby creating the preliminary condition for initiating up the cycle;
- at this point the burner 40 is activated and, via the heater 41, heats the thermal fluid contained in the serpentine 41*a* up to a preset maximum temperature, thereby creating the conditions for the start-up and normal, continuous operation of the heat engine 51.

With reference to FIG. 11, in the position in which the pistons are located, the following main phases can be identified:

Phase of Intake of the Cooled Thermal Fluid.

On leaving the cooler 43, the thermal fluid travels through the conduit 43' and after passing through the intake opening 15', is drawn into the chamber 13'" as result of the moving away of the two pistons 9*b*-7*b*.

Phase of Compression of the Thermal Fluid Taken in.

As the two pistons 7*b*-9*a* move nearer, the thermal fluid (taken in during the previous cycle) is compressed and the temperature thereof increases.

Phase of Accumulation of the Compressed Thermal Fluid.

The compressed fluid, after passing through the discharge opening 16'", the conduit 44' and the check valve 44*a*, is conveyed into the compensating tank 44, where it remains available for immediate use in the subsequent phases.

Phase of Preheating of the Compressed Thermal Fluid.

When, as a result of the input of the heated thermal fluid into the chamber 13', the pressure of the thermal fluid circulating in the serpentine 41*a* falls below that of the compensating tank 44, the fluid, after passing through the check valve 44*b*, flows through the conduit 44" and, whilst travelling through the entire serpentine 42*a* in the section 42'-42", acquires heat energy from the regenerator 42 until arriving at the heating serpentine 41*a*.

The heat engine 51 can comprise, in addition or as an alternative to the check valve 44*b*, a check valve 44*c*, interposed between the outlet 42" of the serpentine 42*a* and the inlet of the heating serpentine 41*a*.

Phase of Superheating of the Compressed-Preheated Thermal Fluid.

The burner 40 (fed with any type of fuel) supplies heat energy to heater 41 (which, instead of the burner 40, can also use other heat sources: solar energy, residual energy from industrial processes, etc.), so that on passing through the entire serpentine 41*a*, the compressed-preheated thermal fluid undergoes a rapid increase in temperature and pressure.

Phase of Expansion of the Superheated Thermal Fluid.

When the piston 7*a*, rotating in the annular cylinder in the direction of motion indicated by the arrows, opens the inlet opening 15' (thus also performing a valve function) the superheated thermal fluid, after travelling through the conduits 41', enters the expansion chamber 13', in which it can expand, causing the pistons to rotate and producing useful work (which may be used to produce electricity or for any other purpose).

Phase of Expulsion of the Spent Thermal Fluid.

As the pistons 7*a*-9*b* move nearer, the chamber 14' is reduced in volume and the spent thermal fluid (already expanded in the previous cycle), after passing through the discharge opening 16' and through the conduit 46, is expelled from the drive unit 1 toward the regenerator 42.

Phase of Recovery of Heat Energy from the Spent Thermal Fluid.

The spent thermal fluid, expelled from the drive unit 1, while passing through the regenerator 42, transfers thereto part of the heat energy still possessed and thus undergoes a first cooling.

Phase of Cooling of the Spent Fluid.

The thermal fluid leaving the regenerator 42, travels through the conduit 46' and, while passing through the cooler 43, transfers thereto another part of heat energy (which can also be recovered and used per any useful purpose) and then undergoes a second cooling, thus ending up in ideal conditions for the continuity of the cycle.

Detailed Description of a New Pneumatic Motor (with Six Pistons).

Figure 12:
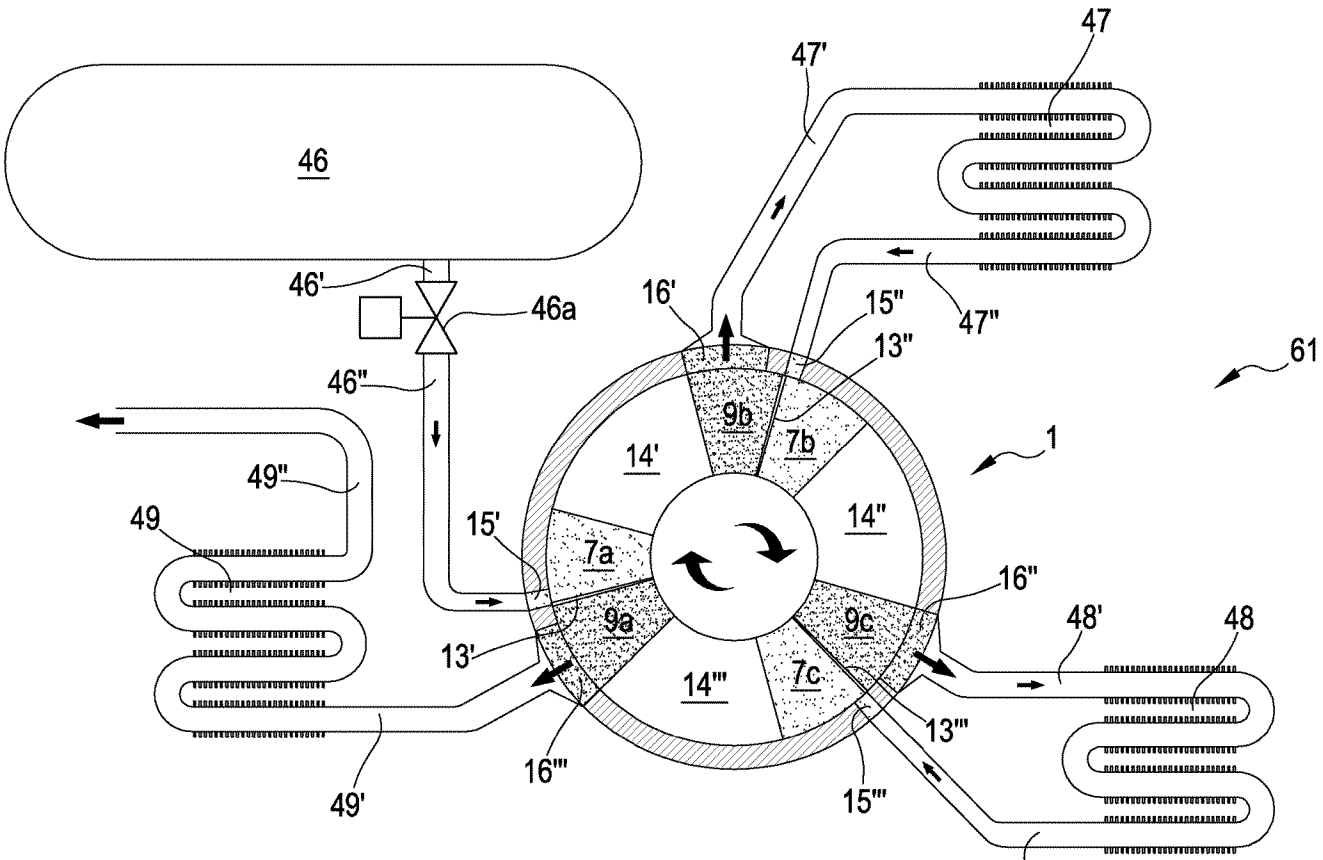
FIG. 12 illustrates a diagram of a six-piston "drive unit" used as a "pneumatic motor"

With reference to FIGS. 2*b* and 12, the pneumatic motor 61, according to the present inventive idea, is configured so as to employ a drive unit 1 which, as a working fluid, uses compressed air.

Start-Up

When it is desired to start up the engine, the primary shaft 17 of the drive unit 1 and the whole transmission system which moves the six pistons 7*a*, 7*b*, 7*c*, 9*a*, 9*b*, 9*c* are made to start rotating by a specific "starter" (not represented in the figure) and the valve 46*a* (manual or motorized) is simultaneously opened.

- upon the rotation of the pistons 7*a*, 7*b*, 7*c*; 9*a*, 9*b*, 9*c*, the conditions of normal operation are established.

The engine cycle substantially takes place, in a continuous manner, in the following main phases:

Phase of Introduction-Expansion of the Compressed Air in the First Section.

The very high-pressure compressed air contained in the tank 46, after passing through the conduits 46',46" (with the valve 46*a* open) and through the inlet opening 15', enters the first expansion chamber 13' of the drive unit 1 where, with the movement of the pistons 9*a*-7*a*, it can expand to produce a part of useful work.

Phase of Expulsion of the Compressed Air from the First Section.

The compressed air, which has already transferred a part of pressure in the previous cycle, forced also by the nearing of the two pistons 7*a*-9*b* and reduction in the volume of the chamber 14', passes through the discharge opening 16', leaves the drive unit 1 and, via the conduit 47', arrives at the first heater 47.

Phase of First Heating of the Compressed Air.

Continuing in its path, the compressed air coming from the first section passes through a first heater 47, in which it undergoes a temperature increase, and then, passing through the conduit 47" and through the inlet opening 15", it is reintroduced into the second expansion chamber 13" of the drive unit 1 where, with the movement of the pistons 9*b*-7*b*, it can expand to produce another part of useful work.

Phase of Expulsion of the Compressed Air from the Second Section.

The compressed air, which has already transferred a part of pressure in the previous cycle, forced also by the nearing of the two pistons 7*b*-9*c* and reduction in the volume of the chamber 14", passes through the discharge opening 16", leaves the drive unit 1 and, via the conduit 48', arrives at the second heater 48.

Phase of Second Heating of the Compressed Air.

Continuing in its path, the compressed air coming from the second section passes through the second heater 48 and then, passing through the conduit 48" and through the inlet opening 15'", it is reintroduced into the third expansion chamber 13'" of the drive unit 1 where, with the movement of the pistons 9*c*-7*c*, it can expand to produce another part of useful work.

Alternative 1_Phase of Expulsion of the Compressed Air from the Third Section, without Cycle Continuity.

The compressed air, which has already transferred a part of pressure in the previous cycle, forced also by the nearing of the two pistons 7*c*-9*a* and reduction in the volume of the chamber 14'", passes through the discharge opening 16'" and leaves the drive unit 1, where the conduit 49' ends and the spent compressed air is released into the surrounding atmosphere.

Alternative 2_Phase of Expulsion of the Compressed Air from the Third Section, Maintaining Cycle Continuity with Other Drive Units Operating in a "Cascade" Mode.

The compressed air, which has already transferred a part of pressure in the previous cycle, forced also by the nearing of the two pistons 7*c*-9*a* and reduction in the volume of the chamber 14'", passes through the discharge opening 16'", leaves the drive unit 1 and, via the conduit 49', arrives at the third heater 49.

Phase of Third Heating of the Compressed Air.

If the use of a second drive unit 1, operating in a "cascade" mode is provided for, the compressed air coming from the third section, continuing in its path, passes through the third heater 49 and then, on travelling through the conduit 49", can be reintroduced into the first expansion chamber of a second drive unit 1 (operating with the first in cascade fashion), continuing the expansion-heating cycles for an additional three stages and if necessary also repeating with other additional drive units 1.

The invention claimed is:

1. A heat engine (29), configured so as to carry out a Rankine-Hirn heat cycle, comprising:

a drive unit (1) comprising:

a casing (2) delimiting therein an annular chamber (12) and having inlet or discharge openings (15', 16', 15", 16", 15'", 16'") in fluid communication with conduits external to the annular chamber (12), in which each inlet or discharge opening (15', 16', 15", 16", 15'", 16'") is angularly spaced from adjacent inlet or discharge openings in order to define an expansion/compression pathway of a thermal fluid in the annular chamber (12);

a first rotor (4) and a second rotor (5) rotatably installed in the casing (2); wherein each of the two rotors (4, 5) has three pistons (7*a*, 7*b*, 7*c*; 9*a*, 9*b*, 9*c*) slidable in the annular chamber (12); wherein the pistons (7*a*, 7*b*, 7*c*) of one rotor (4) of the rotors (4, 5) are angularly alternated with the pistons (9*a*, 9*b*, 9*c*) of the other rotor (5); wherein angularly adjacent pistons (7*a*, 9*a*; 7*b*, 9*b*; 7*c*, 9*c*) delimit six variable-volume chambers (13', 13", 13'"; 14', 14", 14");

a primary shaft (17) operatively connected to the first and second rotors (4, 5);

a transmission (18) operatively interposed between the first and second rotors (4, 5) and the primary shaft (17) and configured so as to transform the rotary motion having a constant angular velocity of the primary shaft (17) into a rotary motion with respective first and second periodically variable angular velocities (ω1, ω2) of the first and second rotors (4, 5) that are offset relative to each another; wherein the transmission (18) is configured so as to confer on the periodically variable angular velocity (ω1, ω2) of each of the rotors (4, 5) six periods of variation for each complete revolution of the primary shaft (17), and wherein the drive unit (1) is used as a rotary volumetric expander;

a steam generator (30) disposed upstream of the drive unit (1) and in fluid communication, via the conduit (34'), with a first inlet opening (15') of the drive unit (1), so as to supply a flow of saturated steam able to contribute to the rotation of the rotors (4, 5) of the drive unit (1) and to produce a first part of useful work;

a steam superheater (36), interposed between a first discharge opening (16') of the drive unit (1) and second and third inlet openings (15", 15'") thereof, in fluid communication, via the conduits (35', 36', 34", 34'"), so as to supply a flow of superheated steam able to contribute to the rotation of the rotors (4, 5) of the drive unit (1) and to produce a second part of useful work;

an electric generator (G) connected to the primary shaft (17) of the drive unit (1), so as to receive mechanical energy and produce electrical energy;

a condenser (31) disposed downstream of the drive unit (1) and in fluid communication, via the conduits (35", 35'", 35'"), with a second and a third discharge opening (16", 16'") of the drive unit (1), so as to receive a flow of spent steam and extract heat therefrom;

a pump (32) in fluid communication, via the conduits (32', 32") with the steam generator (30).

2. A heat engine (29), configured so as to carry out a Rankine-Hirn heat cycle, comprising:

a drive unit (1) comprising:

a casing (2) delimiting therein an annular chamber (12) and having inlet or discharge openings (15', 16', 15", 16", 15'", 16'") in fluid communication with conduits external to the annular chamber (12), in which each inlet or discharge opening (15', 16', 15", 16", 15'", 16'") is angularly spaced from adjacent inlet or discharge openings in order to define an expansion/compression pathway of a thermal fluid in the annular chamber (12);

a first rotor (4) and a second rotor (5) rotatably installed in the casing (2); wherein each of the two rotors (4, 5) has three pistons (7*a*, 7*b*, 7*c*; 9*a*, 9*b*, 9*c*) slidable in the annular chamber (12); wherein the pistons (7*a*, 7*b*, 7*c*) of one rotor (4) of the rotors (4, 5) are angularly alternated with the pistons (9*a*, 9*b*, 9*c*) of the other rotor (5); wherein angularly adjacent pistons (7*a*, 9*a*; 7*b*, 9*b*; 7*c*, 9*c*) delimit six variable-volume chambers (13', 13", 13'"; 14', 14", 14'");

a primary shaft (17) operatively connected to the first and second rotors (4, 5);

a transmission (18) operatively interposed between the first and second rotors (4, 5) and the primary shaft (17) and configured so as to transform the rotary motion having a constant angular velocity of the primary shaft (17) into a rotary motion with respective first and second periodically variable angular velocities (ω1, ω2) of the first and second rotors (4, 5) that are offset relative to each another; wherein the transmission (18) is configured so as to confer on the periodically variable angular velocity (ω1, ω2) of each of the rotors (4, 5) six periods of variation for each complete revolution of the primary shaft (17), and wherein the drive unit (1) is used as a rotary volumetric expander;

a steam generator (30) disposed upstream of the drive unit (1) and in fluid communication, via the conduits (33, 34', 34"), with first two inlet openings (15', 15") of the drive unit (1), so as to supply a flow of superheated steam able to contribute to the rotation of the rotors (4, 5) of the drive unit (1) and produce a first part of useful work;

a steam superheater (36), interposed between first two discharge openings (16', 16") of the drive unit (1) and a third inlet opening (15'") of thereof, in fluid communication, via the conduits (35', 35", 36', 34'"), so as to supply a flow of superheated steam able to contribute to the rotation of the rotors (4, 5) of the drive unit (1) and produce a second part of useful work;

an electric generator (G) connected to the primary shaft (17) of the drive unit (1), so as to receive mechanical energy and produce electrical energy;

a condenser (31) disposed downstream of the drive unit (1) and in fluid communication, via the conduit (35'"), with the discharge opening (16'") of the drive unit (1), so as to receive a flow of spent steam and extract heat therefrom;

a pump (32) in fluid communication, via the conduits (32', 32") with the steam generator (30).

3. A heat engine (29), configured so as to carry out a Rankine-Hirn heat cycle, comprising:

a drive unit (1) comprising:

a casing (2) delimiting therein an annular chamber (12) and having inlet or discharge openings (15', 16', 15", 16", 15'", 16'") in fluid communication with conduits external to the annular chamber (12), in which each inlet or discharge opening (15', 16', 15", 16", 15'", 16'") is angularly spaced from adjacent inlet or discharge openings in order to define an expansion/compression pathway of a thermal fluid in the annular chamber (12);

a first rotor (4) and a second rotor (5) rotatably installed in the casing (2); wherein each of the two rotors (4, 5) has three pistons (7*a*, 7*b*, 7*c*; 9*a*, 9*b*, 9*c*) slidable in the annular chamber (12); wherein the pistons (7*a*, 7*b*, 7*c*) of one rotor (4) of the rotors (4, 5) are angularly alternated with the pistons (9*a*, 9*b*, 9*c*) of the other rotor (5); wherein angularly adjacent pistons (7*a*, 9*a*; 7*b*, 9*b*; 7*c*, 9*c*) delimit six variable-volume chambers (13', 13", 13'"; 14', 14", 14'");

a primary shaft (17) operatively connected to the first and second rotors (4, 5);

a transmission (18) operatively interposed between the first and second rotors (4, 5) and the primary shaft (17) and configured so as to transform the rotary motion having a constant angular velocity of the primary shaft (17) into a rotary motion with respective first and second periodically variable angular velocities (ω1, ω2) of the first and second rotors (4, 5) that are offset relative to each another; wherein the transmission (18) is configured so as to confer on the periodically variable angular velocity (ω1, ω2) of each of the rotors (4, 5) six periods of variation for each complete revolution of the primary shaft (17), and wherein the drive unit (1) is used as a rotary volumetric expander;

a steam generator (30) disposed upstream of the drive unit (1) and in fluid communication, via the conduit (34'), with a first inlet opening (15') of the drive unit (1), so as to supply a flow of saturated steam able to contribute to rotation of the rotors (4, 5) of the drive unit (1) and produce a first part of useful work;

a first steam superheater (36), interposed between a first discharge opening (16') of the drive unit (1) and a second inlet opening (15") thereof, in fluid communication, via the conduits (35', 34"), so as to supply a superheated flow of steam able to contribute to the rotation of the rotors (4, 5) of the drive unit (1) and produce a second part of useful work;

a second steam superheater (37), interposed between a second discharge opening (16") of the drive unit (1) and a third inlet opening (15'") thereof, in fluid communication, via the conduits (35", 34'"), so as to supply a superheated steam flow able to contribute to the rotation of the rotors (4, 5) of the drive unit (1) and produce a third part of useful work;

an electric generator (G) connected to the primary shaft (17) of the drive unit (1), so as to receive mechanical energy and produce electrical energy;

a condenser (31) disposed downstream of the drive unit (1) and in fluid communication, via the conduit (35'"), with a third discharge opening (16'") of the drive unit (1), so as to receive a flow of spent steam and extract heat therefrom;

a pump (32) in fluid communication, via the conduits (32', 32"), with the steam generator (30).

4. A heat engine (29), configured so as to carry out a Rankine-Hirn heat cycle, comprising:

a drive unit (1) comprising:

a casing (2) delimiting therein an annular chamber (12) and having inlet or discharge openings (15', 16', 15", 16", 15'", 16'") in fluid communication with conduits external to the annular chamber (12), in which each inlet or discharge opening (15', 16', 15", 16", 15'", 16''') is angularly spaced from adjacent inlet or discharge openings in order to define an expansion/compression pathway of a thermal fluid in the annular chamber (12);

a first rotor (4) and a second rotor (5) rotatably installed in the casing (2); wherein each of the two rotors (4, 5) has three pistons (7a, 7b, 7c; 9a, 9b, 9c) slidable in the annular chamber (12); wherein the pistons (7a, 7b, 7c) of one rotor (4) of the rotors (4, 5) are angularly alternated with the pistons (9a, 9b, 9c) of the other rotor (5); wherein angularly adjacent pistons (7a, 9a; 7b, 9b; 7c, 9c) delimit six variable-volume chambers (13', 13'', 13'''; 14', 14'', 14''');

a primary shaft (17) operatively connected to the first and second rotors (4, 5);

a transmission (18) operatively interposed between the first and second rotors (4, 5) and the primary shaft (17) and configured so as to transform the rotary motion having a constant angular velocity of the primary shaft (17) into a rotary motion with respective first and second periodically variable angular velocities (ω1, ω2) of the first and second rotors (4, 5) that are offset relative to each another; wherein the transmission (18) is configured so as to confer on the periodically variable angular velocity (ω1, ω2) of each of the rotors (4, 5) six periods of variation for each complete revolution of the primary shaft (17), and wherein the drive unit (1) is used as a rotary volumetric expander;

a steam generator (30) disposed upstream of the drive unit (1) and in fluid communication, via the conduits (33, 34', 34'', 34'''), with the inlet openings (15', 15'', 15''') of the drive unit (1), in order to supply thereto a flow of saturated steam able to rotate the rotors (4, 5) of the drive unit (1) and produce useful work;

an electric generator (G) connected to the primary shaft (17) of the drive unit (1), so as to receive mechanical energy and produce electrical energy;

a condenser (31) disposed downstream of the drive unit (1) and in fluid communication, via the conduits (35', 35'', 35''', 35''''), with the discharge openings (16', 16'', 16''') of the drive unit (1), so as to receive a flow of spent steam and extract heat therefrom;

a pump (32) in fluid communication, via the conduits (32', 32''), with the steam generator (30);

wherein the heat engine (29) is equipped with a heating apparatus (300) comprising:

a first superheater (71) interposed between the steam generator and an inlet opening (15') of the drive unit (1), by means of which superheated steam flows into a first expansion chamber of the drive unit (1); and/or a second superheater (72) interposed between a discharge opening (16') of the drive unit (1), from which steam is discharged at the end of expansion in the first chamber, and an inlet opening (15'') of the drive unit (1), the second superheater being configured so as to receive spent steam expelled by the first expansion chamber and superheat it in such a way that the superheated steam flows, via the inlet opening (15''), into the second expansion chamber of the drive unit (1); and/or a third superheater (73) interposed between a discharge opening (16'') of the drive unit (1), from which steam is discharged at the end of expansion in a second chamber, and the inlet opening (15''') of the drive unit (1), the second superheater being configured so as to receive the spent steam expelled by the second expansion chamber and superheat it, in such a way that the superheated steam flows, via the inlet opening (15''') into a third expansion chamber of the drive unit (1);

wherein the heat engine (29) comprises a regenerator (80), interposed between a discharge opening (16''') of the drive unit (1), from which the spent steam is discharged at the end of expansion in the third expansion chamber, and the condenser (31), where the steam is condensed and transformed into a flow of water, thus recovering heat, the regenerator (80) being configured so as to receive the steam expelled from the drive unit (1) at the end of expansion in the third expansion chamber and exchange the residual heat of the steam with the flow of water downstream of the condenser (31), pumped under high pressure by the pump (32) back toward the steam generator (30) so as to lend continuity to the closed-circuit cycle;

wherein the heating apparatus (300) comprises, operatively downstream of the first superheater, the second superheater and the third superheater (71, 72, 73), a fume temperature reducer (75), the reducer (75) being configured so as to extract heat from fumes produced by the heating apparatus and being interposed between the discharge opening (16''') of the drive unit (1), from which the spent steam is discharged at the end of expansion in the third expansion chamber, and the regenerator (80), in which the steam exchanges its residual heat with the flow of condensed water directed toward the steam generator (30), the fume temperature reducer (75) being configured so as to receive, on an inlet side, the spent steam output by the drive unit (1), in order to exchange heat with the fumes of the heating apparatus (300), thereby raising the temperature of the steam, and deliver, from an outlet side, the heated steam directed to the regenerator (80).

5. A heat engine (51), comprising:

a drive unit (1) comprising:

a casing (2) delimiting therein an annular chamber (12) and having inlet or discharge openings (15', 16', 15'', 16'', 15''', 16''') in fluid communication with conduits external to the annular chamber (12), in which each inlet or discharge opening (15', 16', 15'', 16'', 15''', 16''') is angularly spaced from adjacent inlet or discharge openings in order to define an expansion/compression pathway of a thermal fluid in the annular chamber (12);

a first rotor (4) and a second rotor (5) rotatably installed in the casing (2); wherein each of the two rotors (4, 5) has three pistons (7a, 7b, 7c; 9a, 9b, 9c) slidable in the annular chamber (12); wherein the pistons (7a, 7b, 7c) of one rotor (4) of the rotors (4, 5) are angularly alternated with the pistons (9a, 9b, 9c) of the other rotor (5); wherein angularly adjacent pistons (7a, 9a; 7b, 9b; 7c, 9c) delimit six variable-volume chambers (13', 13'', 13'''; 14', 14'', 14''');

a primary shaft (17) operatively connected to the first and second rotors (4, 5);

a transmission (18) operatively interposed between the first and second rotors (4, 5) and the primary shaft (17) and configured so as to transform the rotary motion having a constant angular velocity of the primary shaft (17) into a rotary motion with respective first and second periodically variable angular velocities (ω1, ω2) of the first and second rotors (4, 5) that are offset relative to each another; wherein the transmission (18) is configured so as to confer on the periodically variable angular velocity (ω1, ω2) of each of the rotors (4, 5) six periods of variation for each complete revolution of the primary shaft (17), and wherein the drive unit (1) is used as a rotary volumetric expander;

a cooler (43), in fluid communication, via a conduit (46'), with a regenerator (42), and able to cool the thermal fluid in circulation, with or without heat recovery;

a first section of the drive unit (1) in fluid communication with the cooler (43), via the conduit (43'), where, following the movement away of two pistons (9*c*, 7*c*), the thermal fluid, passing through an inlet opening (15'''), is drawn into a chamber (13''');

a second section of the drive unit (1), where, following the nearing movement of the two pistons (7*c*, 9*a*), the thermal fluid previously taken in is compressed in a chamber (14''') and then, on passing through a discharge opening (16'''), a conduit (44') and a check valve (44*a*), is conveyed into a compensating tank (44);

the compensating tank (44), configured so as to accumulate the compressed thermal fluid in order to make it always and immediately available, via the conduits (44", 42') and a check valve (44*b*), for subsequent use thereof, in a continuous mode;

a preheating serpentine (42*a*), in fluid communication, via the conduit (42") with a heating serpentine (41*a*), and having the purpose of preheating the thermal fluid in a pathway thereof towards a heater (41);

the heater (41), configured so as to be able to superheat the thermal fluid circulating in the heating serpentine (41*a*) by using heat energy produced by a burner (40);

the burner (40), capable of supplying heat energy to the heater (41);

a third section of the drive unit (1), in fluid communication with the heating serpentine (41*a*), via conduits (41', 41", 41"), and able to receive, via inlet openings (15', 15"), the thermal fluid heated up to a high temperature under pressure in the heating serpentine (41*a*) in order then to expand the fluid in the chambers (13', 13"), delimited respectively by the pistons (9*a*, 7*a*, 9*b*, 7*b*), in order to rotate the pistons in the direction of the arrows and produce useful work;

a fourth section of the drive unit (1), in fluid communication with the regenerator (42), through the discharge openings (16', 16") and conduits (45', 45", 46), and in which, due to the reduction in volume of the two chambers (14', 14") determined by the nearing of the two pairs of pistons (7*a*, 9*b*, 7*b*, 9*c*), the spent thermal fluid is forcedly expelled towards the regenerator (42);

the regenerator (42), in fluid communication with the drive unit (1), configured so as to acquire heat energy from the spent thermal fluid and use it to preheat, via the preheating serpentine (42*a*), the thermal fluid to be sent to the heating serpentine (41*a*).

6. The heat engine (51), according to claim 5, where the conduits (41", 41''') for the thermal fluid and the conduits (45', 45") are provided with appropriate shut-off/regulating valves, manually or automatically controlled, in order to be able to intercept the heat flow of one or the other inlet opening (15', 15") and the corresponding discharge openings (16', 16") of the drive unit (1), or to divert the flow to one or the other of the two.

7. A heat engine (51), comprising:

a drive unit (1) provided with a casing (2) delimiting therein an annular chamber (12) and having two inlet openings (15', 15") and two discharge openings (16', 16"), the drive unit comprising a first rotor (4) and a second rotor (5) rotatably installed in the casing (2); wherein each of the two rotors (4, 5) has two pistons (7*a*, 7*b*; 9*a*, 9*b*) slidable in the annular chamber;

a cooler (43), in fluid communication, via a conduit (46'), with a regenerator (42), and able to cool thermal fluid in circulation, with or without heat recovery;

a first section of the drive unit (1) in fluid communication with the cooler (43), via a conduit (43'), where, following a movement away movement of the two pistons (9*c*, 7*c*) the thermal fluid, passing through an inlet opening (15'''), is drawn into a chamber (13");

a second section of the drive unit (1), where, following the nearing movement of the two pistons (7*b*, 9*a*), the thermal fluid previously taken in is compressed in a chamber (14") and then, on passing through a first discharge opening (16"), a conduit (44') and a check valve (44*a*), is conveyed into a compensating tank (44);

the compensating tank (44), configured so as to accumulate compressed thermal fluid in order to make it always and immediately available, via conduits (44", 42') and a check valve (44*b*), for subsequent use thereof, in a continuous mode;

a preheating serpentine (42*a*), in fluid communication, via a conduit (42"), with a heating serpentine (41*a*), and having the purpose of preheating the thermal fluid in a pathway thereof towards a heater (41);

the heater (41), configured so as to be able to superheat the thermal fluid circulating in the heating serpentine (41*a*) by using heat energy produced by a burner (40);

the burner (40), capable of supplying heat energy to the heater (41);

a third section of the drive unit (1), in fluid communication with the heating serpentine (41*a*), via a conduit (41'), and able to receive, via a second inlet opening (15'), the thermal fluid heated up to a high temperature under pressure in the heating serpentine (41*a*) in order then to expand the fluid in a chamber (13'), delimited by the pistons (9*a*, 7*a*), in order to rotate the pistons and produce useful work;

a fourth section of the drive unit (1), in fluid communication with the regenerator (42), through a second discharge opening (16') and a conduit (46), and in which, due to the reduction in volume of the chamber (14') determined by the nearing of the two pistons (7*a*, 7*b*), spent thermal fluid is forcedly expelled towards the regenerator (42);

the regenerator (42), in fluid communication with the drive unit (1), configured so as to acquire heat energy from the spent thermal fluid and use it to preheat, via the preheating serpentine (42*a*), the thermal fluid to be sent to a heating serpentine (41*a*).

8. A pneumatic motor, comprising:

a drive unit (1) comprising:

a casing (2) delimiting therein an annular chamber (12) and having inlet or discharge openings (15', 16', 15", 16", 15''', 16''') in fluid communication with conduits external to the annular chamber (12), in which each inlet or discharge opening (15', 16', 15", 16", 15''', 16''') is angularly spaced from adjacent inlet or discharge openings in order to define an expansion/compression pathway of compressed air in the annular chamber (12);

a first rotor (4) and a second rotor (5) rotatably installed in the casing (2); wherein each of the two rotors (4, 5) has three pistons (7*a*, 7*b*, 7*c*; 9*a*, 9*b*, 9*c*) slidable in the annular chamber (12); wherein the pistons (7*a*, 7*b*, 7*c*) of one rotor (4) of the rotors (4, 5) are angularly alternated with the pistons (9*a*, 9*b*, 9*c*) of the other rotor (5); wherein angularly adjacent pistons (7*a*, 9*a*; 7*b*, 9*b*; 7*c*, 9*c*) delimit six variable-volume chambers (13', 13", 13'"; 14', 14", 14'");

a primary shaft (17) operatively connected to the first and second rotors (4, 5);

a transmission (18) operatively interposed between the first and second rotors (4, 5) and the primary shaft (17) and configured so as to transform the rotary motion having a constant angular velocity of the primary shaft (17) into a rotary motion with respective first and second periodically variable angular velocities (ω1, ω2) of the first and second rotors (4, 5) that are offset relative to each another; wherein the transmission (18) is configured so as to confer on the periodically variable angular velocity (ω1, ω2) of each of the rotors (4, 5) six periods of variation for each complete revolution of the primary shaft (17), and wherein the drive unit (1) is used as a rotary volumetric expander;

a compressed air tank (46) in direct fluid communication, via conduits (46', 46") and a manual or automatic shut-off/regulating valve (46*a*), with the drive unit (1) in order to supply high-pressure compressed air to the drive unit;

a first section of the drive unit (1) which, via a first inlet opening (15'), receives compressed air at a high pressure, which, because of the expansion thereof in a first chamber (13'), delimited by the pistons (9*a*, 7*a*), rotates the latter producing a first part of work;

a first heater (47) in direct fluid communication, via a conduit (47'), with a first discharge opening (16') of the drive unit (1) in order to receive therethrough the compressed air which, as a result of the nearing of the two pistons (7*a*, 9*b*), is discharged from an expansion chamber (14') so as to be heated in the first heater (47) and then reintroduced into the drive unit (1) through a conduit (47") and the second inlet opening (15");

a second section of the drive unit (1) which, through a second inlet opening (15"), receives compressed air at medium pressure, which, because of the expansion thereof in a second chamber (13"), delimited by pistons (9*b*, 7*b*), rotates the pistons (9*b*, 7*b*) in a direction of motion, producing a second part of work;

a second heater (48) in direct fluid communication, via a conduit (48'), with a second discharge opening (16") of the drive unit (1) in order to receive therethrough the compressed air which, as a result of the nearing of two pistons (7*b*, 9*c*), is discharged from the expansion chamber (14") so as to be heated in the second heater (48) and then reintroduced into the drive unit (1) through a conduit (48") and a third inlet opening (15'");

a third section of the drive unit (1) which, through the third inlet opening (15"), receives compressed air at low pressure, which, because of the expansion thereof in a third chamber (13'"), delimited by pistons (9*c*, 7*c*), rotates the pistons (9*c*, 7*c*) in the direction of motion, producing a third part of work;

a conduit (49') in communication with the third discharge opening (16'") of the drive unit (1) in order to receive therethrough the compressed air which, as a result of the nearing of the two pistons (7*c*, 9*a*), is discharged from the expansion chamber (14'") in order to be then discharged into a surrounding environment.

9. The pneumatic motor according to claim 8, comprising:

a third heater (49) in direct fluid communication, via the conduit (49'), with the third discharge opening (16'") of the drive unit (1) in order to receive therethrough the compressed air, which, as a result of the nearing of the two pistons (7*c*, 9*a*), is discharged from the expansion chamber (14'") so as to be heated in the third heater (49) and then reintroduced into an additional drive unit arranged in cascade with the drive unit (1).

* * * * *